US010744762B2

(12) United States Patent
Matsumoto

(10) Patent No.: US 10,744,762 B2
(45) Date of Patent: Aug. 18, 2020

(54) LIQUID EJECTING APPARATUS

(71) Applicant: SEIKO EPSON CORPORATION, Tokyo (JP)

(72) Inventor: Yusuke Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 16/260,209

(22) Filed: Jan. 29, 2019

(65) Prior Publication Data

US 2019/0232647 A1 Aug. 1, 2019

(30) Foreign Application Priority Data

Jan. 31, 2018 (JP) ..... 2018-015776
Jul. 30, 2018 (JP) ..... 2018-142334

(51) Int. Cl.
*B41J 2/045* (2006.01)
*B41J 2/14* (2006.01)

(52) U.S. Cl.
CPC ..... *B41J 2/04581* (2013.01); *B41J 2/0455* (2013.01); *B41J 2/04541* (2013.01); *B41J 2/04588* (2013.01); *B41J 2/04593* (2013.01); *B41J 2/04596* (2013.01); *B41J 2/14201* (2013.01); *B41J 2/14233* (2013.01)

(58) Field of Classification Search
CPC ..... B41J 2/04581; B41J 2/04588; B41J 2/04593; B41J 2/0455; B41J 2/04541; B41J 2/14233; B41J 2/14201; B41J 2/04596
See application file for complete search history.

(56) References Cited

U.S. PATENT DOCUMENTS

2006/0044337 A1* 3/2006 Takata ..... B41J 2/0457 347/14
2016/0167370 A1 6/2016 Uematsu
2016/0221332 A1* 8/2016 Sano ..... B41J 2/04593
2017/0057221 A1 3/2017 Nozawa

FOREIGN PATENT DOCUMENTS

JP 2017-043007 A 3/2017
JP 2017-177333 A 10/2017

OTHER PUBLICATIONS

IP.com search (Year: 2019).*
The Extended European Search Report for the corresponding European Patent Application No. 19154916.1 dated Jun. 11, 2019.

* cited by examiner

*Primary Examiner* — Lisa Solomon
(74) *Attorney, Agent, or Firm* — Global IP Counselors, LLP

(57) ABSTRACT

A liquid ejecting apparatus includes a drive circuit in which a first voltage signal is output from an output terminal, a piezoelectric element that includes a first electrode to which the first voltage signal is supplied and a second electrode to which a second voltage signal is supplied, and a first switch element that is electrically connected to the output terminal and the first electrode. The liquid ejecting apparatus has a first mode in which a voltage value of the second voltage signal is controlled to be a first voltage, and a second mode in which the voltage value of the second voltage signal is controlled to be a second voltage lower than the first voltage, a voltage value of the first voltage signal is controlled to approximate the voltage value of the second voltage signal, and the first switch element is controlled to be turned on.

11 Claims, 25 Drawing Sheets

FIG. 4

| OPERATION MODE | | PRINT MODE | STANDBY MODE | TRANSITION MODE | SLEEP MODE |
|---|---|---|---|---|---|
| STATE SIGNAL | MC1 | H | H | L | L |
| | MC2 | H | L | L | H |

FIG. 14

| OPERATION MODE | | PRINT MODE | | | | STANDBY MODE | TRANSITION MODE | SLEEP MODE |
|---|---|---|---|---|---|---|---|---|
| | | LARGE DOT | MEDIUM DOT | SMALL DOT | MINUTE VIBRATION | | | |
| [SIH, SIL] | | [1, 1] | [1, 0] | [0, 1] | [0, 0] | – | – | – |
| MC1 | | H | | | | H | L | L |
| MC2 | | H | | | | L | L | H |
| S | T1 | H | H | L | L | H | H | L |
| | T2 | H | L | H | L | | | |
| | T3 | L | L | L | H | | | |

FIG. 24

| OPERATION MODE | | PRINT MODE | | | | STANDBY MODE | TRANSITION MODE | SLEEP MODE |
|---|---|---|---|---|---|---|---|---|
| | | LARGE DOT | MEDIUM DOT | SMALL DOT | MINUTE VIBRATION | | | |
| [SIH, SIL] | | [1, 1] | [1, 0] | [0, 1] | [0, 0] | – | – | – |
| MC1 | | H | | | | H | L | L |
| MC2 | | H | | | | L | L | H |
| S | T1 | H | H | L | L | H | H | H |
| | T2 | H | L | H | L | | | |
| | T3 | L | L | L | H | | | |

LIQUID EJECTING APPARATUS

The entire disclosure of Japanese Patent Application No. 2018-015776, filed Jan. 31, 2018 and 2018-142334, filed Jul. 30, 2018 are expressly incorporated by reference herein.

BACKGROUND

1. Technical Field

The present invention relates to a liquid ejecting apparatus.

2. Related Art

It is known that a piezoelectric element such as a piezo element is used as an ink jet printer (liquid ejecting apparatus) which ejects a liquid such as ink to print an image or a document. The piezoelectric element is provided in the print head, corresponding to a plurality of nozzles that eject the ink and a cavity that stores the ink ejected from the nozzles. As the piezoelectric element is displaced according to a drive signal, a vibration plate provided between the piezoelectric element and the cavity is displaced, and the volume of the cavity changes. Thereby, the predetermined amount of ink is ejected from the nozzle at a predetermined timing, and dots are formed on a medium.

JP-A-2017-43007 discloses a liquid ejecting apparatus in which a drive signal generated based on print data is supplied to an upper electrode and a reference voltage is supplied to a lower electrode for a piezoelectric element that is displaced based on a potential difference between the upper electrode and the lower electrode, and which controls a displacement of the piezoelectric element by controlling the drive signal and ejects ink.

In addition to a print state in which ink can be ejected as described above, the liquid ejecting apparatus also has a state in which print data is not supplied and ink is not ejected. The state in which ink is not ejected include a plurality of states, such as, a standby state in which it is possible to shift to a print state in a short time in a case where the print data is supplied, a sleep state in which power consumption is reduced for the standby state, and a transition state in which the standby state is shifted to the sleep state. A piezoelectric element is displaced in a case where a potential difference is generated between an upper electrode and a lower electrode even in a state where the ink is not ejected.

In a case where the state where the piezoelectric element is displaced is continued, a stress occurs in the piezoelectric element and a vibration plate. The stress concentrates on, for example, a contact point or the like between the vibration plate and a cavity. Then, a crack or the like may occur in the vibration plate due to the stress.

In a case where the crack occurs in the vibration plate, the ink stored in the cavity leaks out from the crack, and the amount of ejected ink may fluctuate depending on a change in the volume of cavity. As a result, ink ejection accuracy is decreased.

Furthermore, in a case where the ink leaked from the crack adheres to both the upper electrode and the lower electrode, a current flows through the ink between the upper electrode and the lower electrode. Accordingly, a potential of a reference voltage supplied to the lower electrode varies. As a result, for example, in a case where the reference voltage is commonly supplied to a plurality of piezoelectric elements, the variation in the potential of the reference voltage affects the displacement of the plurality of piezoelectric elements. That is, the ejection accuracy of the entire liquid ejecting apparatus may be affected, not limited to the ejection accuracy from the nozzle corresponding to the vibration plate in which the crack occurs.

The problem caused by the displacement of the piezoelectric element in a state where the ink is not ejected is a new problem not disclosed in JP-A-2017-43007.

SUMMARY

The invention can be realized in the following aspects.

According to an aspect of the invention, a liquid ejecting apparatus includes a drive circuit in which a first voltage signal is output from an output terminal, a piezoelectric element that includes a first electrode to which the first voltage signal is supplied and a second electrode to which a second voltage signal is supplied and is displaced by a potential difference between the first electrode and the second electrode, a cavity which is filled with a liquid that is ejected from a nozzle in accordance with the displacement of the piezoelectric element, a vibration plate that is provided between the cavity and the piezoelectric element, and a first switch element that is electrically connected to the output terminal and the first electrode. The liquid ejecting apparatus has a first mode in which the liquid is ejected and a voltage value of the second voltage signal is controlled to be a first voltage, and a second mode in which the liquid is not ejected, the voltage value of the second voltage signal is controlled to be a second voltage lower than the first voltage, a voltage value of the first voltage signal is controlled to approximate the voltage value of the second voltage signal, and the first switch element is controlled to be turned on.

In the liquid ejecting apparatus, printing may not be performed on a medium in the second mode.

According to another aspect of the invention, a liquid ejecting apparatus includes a drive circuit in which a first voltage signal is output from an output terminal, a piezoelectric element that includes a first electrode to which the first voltage signal is supplied and a second electrode to which a second voltage signal is supplied and is displaced by a potential difference between the first electrode and the second electrode, a cavity which is filled with a liquid that is ejected from a nozzle in accordance with the displacement of the piezoelectric element, a vibration plate that is provided between the cavity and the piezoelectric element, and a first switch element that is electrically connected to the output terminal and the first electrode. The liquid ejecting apparatus has a first mode in which the liquid is ejected and a voltage value of the second voltage signal is controlled to be a first voltage, and a third mode in which the liquid is not ejected, the voltage value of the second voltage signal is a second voltage lower than the first voltage, a voltage value of the first voltage signal is controlled so as to become the voltage value of the second voltage signal, and the first switch element is controlled to be turned on.

In the liquid ejecting apparatus, printing may not be performed on a medium in the third mode.

In the liquid ejecting apparatus, a plurality of the nozzles may be provided at a density of 300 or more per inch, and a plurality of the piezoelectric elements may be provided corresponding to the plurality of nozzles.

In the liquid ejecting apparatus, a third voltage signal having a voltage value higher than the voltage value of the first voltage signal and the voltage value of the second voltage signal may be input to a node which is electrically connected to the output terminal and the first switch element, via a resistance element.

In the liquid ejecting apparatus, the drive circuit may include a feedback circuit that feeds back the first voltage signal which is output from the output terminal, a modulation circuit that generates a modulation signal, based on an original signal which is a source of the first voltage signal and a signal which is obtained by feeding back the first voltage signal, and an output circuit that generates the first voltage signal by amplifying and demodulating the modulation signal.

In the liquid ejecting apparatus, the liquid ejecting apparatus may further include a discharge circuit that discharges electric charges between the output terminal and the first electrode.

In the liquid ejecting apparatus, the discharge circuit may include a second switch element having one end which is electrically connected to the output terminal and the other end which is connected to a ground potential.

BRIEF DESCRIPTION OF THE DRAWINGS

The invention will be described with reference to the accompanying drawings, wherein like numbers reference like elements.

FIG. 4 is a diagram illustrating a relationship between state signals and each operation mode.

FIG. 14 is a diagram illustrating decoded content.

FIG. 24 is a diagram illustrating decoded content in a second embodiment.

DESCRIPTION OF EXEMPLARY EMBODIMENTS

Preferred embodiments of the invention will be described below with reference to the drawings. The drawings which are used are for the sake of convenience. The embodiments which will be described below do not unduly limit the content of the invention described in the claims. In addition, not all configurations which will be described below are essential configuration elements of the invention.

Hereinafter, an ink jet printer, which is a print apparatus that ejects ink as a liquid, will be described as an example of a liquid ejecting apparatus according to the invention.

Examples of the liquid ejecting apparatus include a print apparatus such as a printer, a color material ejecting apparatus used for manufacturing a color filter of a liquid crystal display or the like, an electrode material ejecting apparatus used for forming an electrode of an organic EL display, a surface emitting display, or the like, a biological organic material ejecting apparatus used for manufacturing a biochip, and the like.

1. First Embodiment

1.1 Outline of Liquid Ejecting Apparatus

A print apparatus which is an example of a liquid ejecting apparatus according to the present embodiment is an ink jet printer that forms dots on a print medium such as paper by ejecting ink in accordance with image data supplied from an external host computer, thereby, printing an image including a characters, a graphic, and the like according to the image data.

Figure 1:
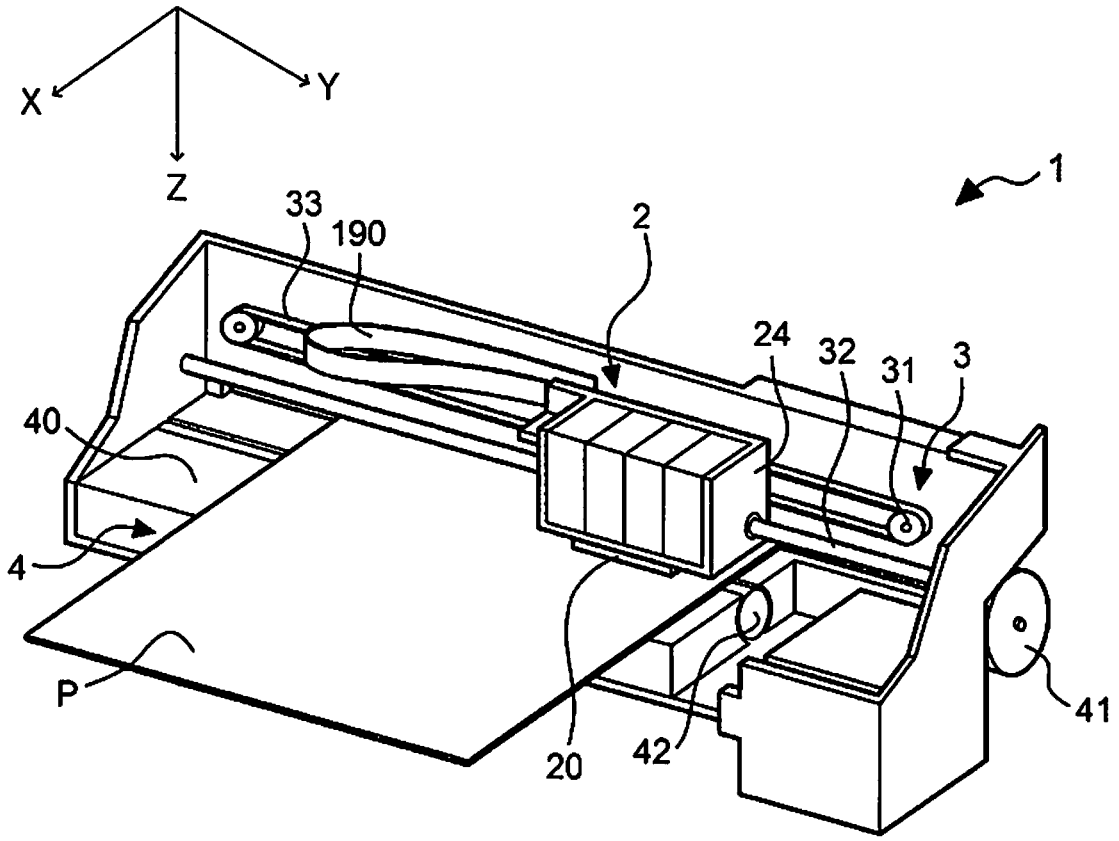
FIG. 1 is a perspective view illustrating a schematic configuration of a liquid ejecting apparatus.

FIG. 1 is a perspective view illustrating a schematic configuration of a liquid ejecting apparatus 1. In FIG. 1, a direction in which a medium P is transported is defined as a direction X, a direction which intersects the direction X and in which a moving object 2 reciprocates is defined as a direction Y, and a direction in which ink is ejected is defined as a direction Z. In the first embodiment, it is described that the directions X, Y, and Z are orthogonal to each other.

As illustrated in FIG. 1, the liquid ejecting apparatus 1 includes the moving object 2 and a moving mechanism 3 that reciprocates the moving object 2 in the direction Y.

The moving mechanism 3 includes a carriage motor 31 which is a drive source of the moving object 2, a carriage guide shaft 32 having both ends fixed, and a timing belt 33 that extends substantially in parallel with the carriage guide shaft 32 and is driven by the carriage motor 31.

The carriage 24 included in the moving object 2 is supported by the carriage guide shaft 32 reciprocably and is fixed to a part of the timing belt 33. By driving the timing belt 33 by using the carriage motor 31, the moving object 2 reciprocates along the direction Y while being guided by the carriage guide shaft 32.

A head unit 20 is provided in a portion of the moving object 2 that faces the medium P. As will be described below, the head unit 20 includes many nozzles, and ejects ink from the nozzles in the direction Z. In addition, various control signals and the like are supplied to the head unit 20 via a flexible cable 190.

The liquid ejecting apparatus 1 includes a transport mechanism 4 for transporting the medium P in the direction X on the platen 40. The transport mechanism 4 includes a transport motor 41 which is a drive source and a transport roller 42 which is rotated by the transport motor 41 and transports the medium P in the direction X.

At the timing when the medium P is transported by the transport mechanism 4, the head unit 20 ejects ink onto the medium P, and thereby, an image is formed on a surface of the medium P.

Figure 2:
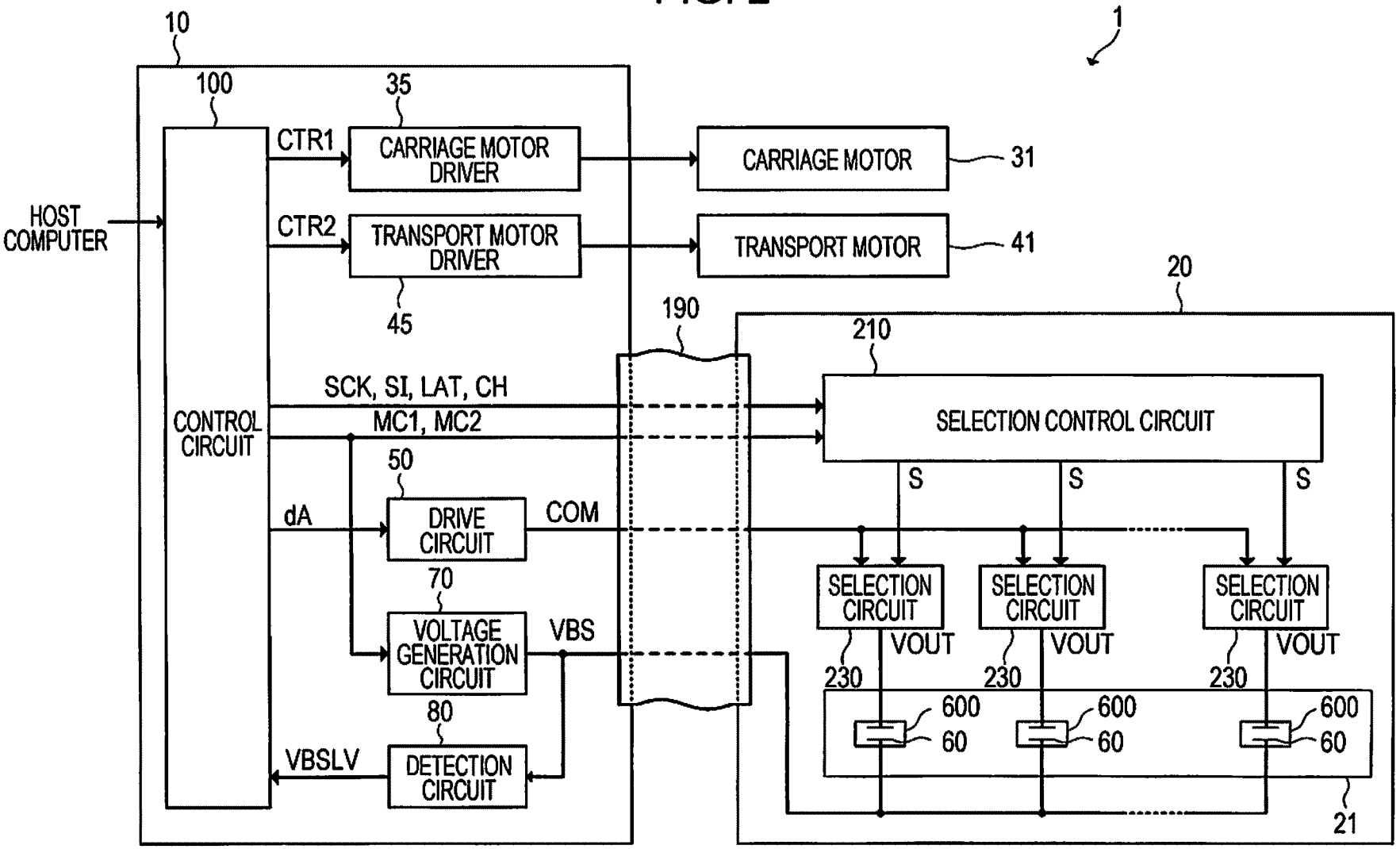
FIG. 2 is a block diagram illustrating an electrical configuration of the liquid ejecting apparatus.

FIG. 2 is a block diagram illustrating an electrical configuration of the liquid ejecting apparatus 1. As illustrated in FIG. 2, the liquid ejecting apparatus 1 includes a control unit 10 and the head unit 20. The control unit 10 and the head unit 20 are connected to each other via the flexible cable 190.

The control unit 10 includes a control circuit 100, a carriage motor driver 35, a transport motor driver 45, a drive circuit 50, a voltage generation circuit 70, and a detection circuit 80.

The control circuit 100 outputs a plurality of control signals and the like for controlling various configurations, based on image data supplied from a host computer. Specifically, the control circuit 100 supplies a control signal CTR1 to the carriage motor driver 35. The carriage motor driver 35 drives a carriage motor 31 in response to the control signal CTR1. Thereby, movement of the carriage 24 in the direction Y is controlled.

In addition, the control circuit 100 supplies a control signal CTR2 to the transport motor driver 45. The transport motor driver 45 drives the transport motor 41 in response to the control signal CTR2. Thereby, movement, which is made by the transport mechanism 4, of the medium P in the direction X is controlled.

In addition, the control circuit 100 supplies data dA which is a digital signal to the drive circuit 50. As will be described in detail below, the drive circuit 50 converts the data dA into an analog signal, performs a class-D amplification of the data dA to generate a drive signal COM, and supplies the drive signal to the head unit 20. That is, the data dA is a signal for defining a waveform of the drive signal COM to be supplied to the head unit 20.

In addition, the control circuit 100 supplies state signal MC1 and MC2 to the voltage generation circuit 70. The voltage generation circuit 70 generates a reference voltage signal VBS having a voltage value based on the state signals MC1 and MC2. The reference voltage signal VBS is branched by the control unit 10 and is supplied to the detection circuit 80 and the head unit 20. The detection circuit 80 detects a voltage value of the supplied reference voltage signal VBS and supplies a reference voltage value signal VBSLV indicating the detection result to the control circuit 100.

Furthermore, the control circuit 100 supplies the head unit 20 with a clock signal SCK, a print data signal SI, the state signals MC1 and MC2, a latch signal LAT, and a change signal CH.

The head unit 20 includes a selection control circuit 210, a plurality of selection circuits 230, and a recording head 21. The recording head 21 includes a plurality of ejection units 600 each including a piezoelectric element 60. The plurality of ejection units 600 are provided corresponding to the plurality of selection circuits 230.

As will be described in detail below, the selection control circuit 210 instructs each selection circuit 230 whether or not to select the drive signal COM, based on the print data signal SI, the state signals MC1 and MC2, the latch signal LAT, and the change signal CH which are supplied from the control circuit 100.

The selection circuit 230 selects the drive signal COM in accordance with the instruction of the selection control circuit 210 and supplies the selected drive signal COM to one end of the piezoelectric element 60 of the ejection unit 600 included in the recording head 21 as a drive signal VOUT. The reference voltage signal VBS is supplied to the other end of the piezoelectric element 60 in common.

The piezoelectric element 60 included in the ejection unit 600 is provided corresponding to each of the plurality of nozzles in the recording head 21. The piezoelectric element 60 is displaced in accordance with a potential difference between a voltage value of the drive signal VOUT supplied to one end and a voltage value of the reference voltage signal VBS supplied to the other end. Then, the amount of ink according to the displacement of the piezoelectric element 60 is ejected from the nozzle.

In FIG. 2, it is described that the liquid ejecting apparatus 1 includes one head unit 20, but a plurality of head units 20 may be included. In addition, in FIG. 2, it is described that the head unit 20 includes one recording head 21, but a single head unit 20 may include a plurality of recording heads 21. In addition, the drive circuit 50 may be included in the head unit 20.

Here, the liquid ejecting apparatus 1 according to the first embodiment has a plurality of operation modes.

Specifically, the liquid ejecting apparatus 1 has a print mode, a standby mode, a transition mode, and a sleep mode as at least a part of a plurality of operation modes. The print mode is an operation mode in which printing is performed on the medium P by ejecting ink onto the medium P based on the supplied image data. The standby mode is an operation mode in which the apparatus stands by while waiting while reducing power consumption with respect to the print mode and printing can be restarted in a short time in a case where data is supplied. The transition mode is an operation mode between the standby mode and the sleep mode. The sleep mode is an operation mode in which power consumption can be further reduced with respect to the standby mode. In the standby mode, transition mode, and the sleep mode, the image data is not supplied to the liquid ejecting apparatus 1, and thus, the liquid ejecting apparatus 1 does not eject ink to the medium P. That is, the standby mode, the transition mode, and the sleep mode are modes in which the liquid ejecting apparatus 1 does not perform printing.

Figure 3:
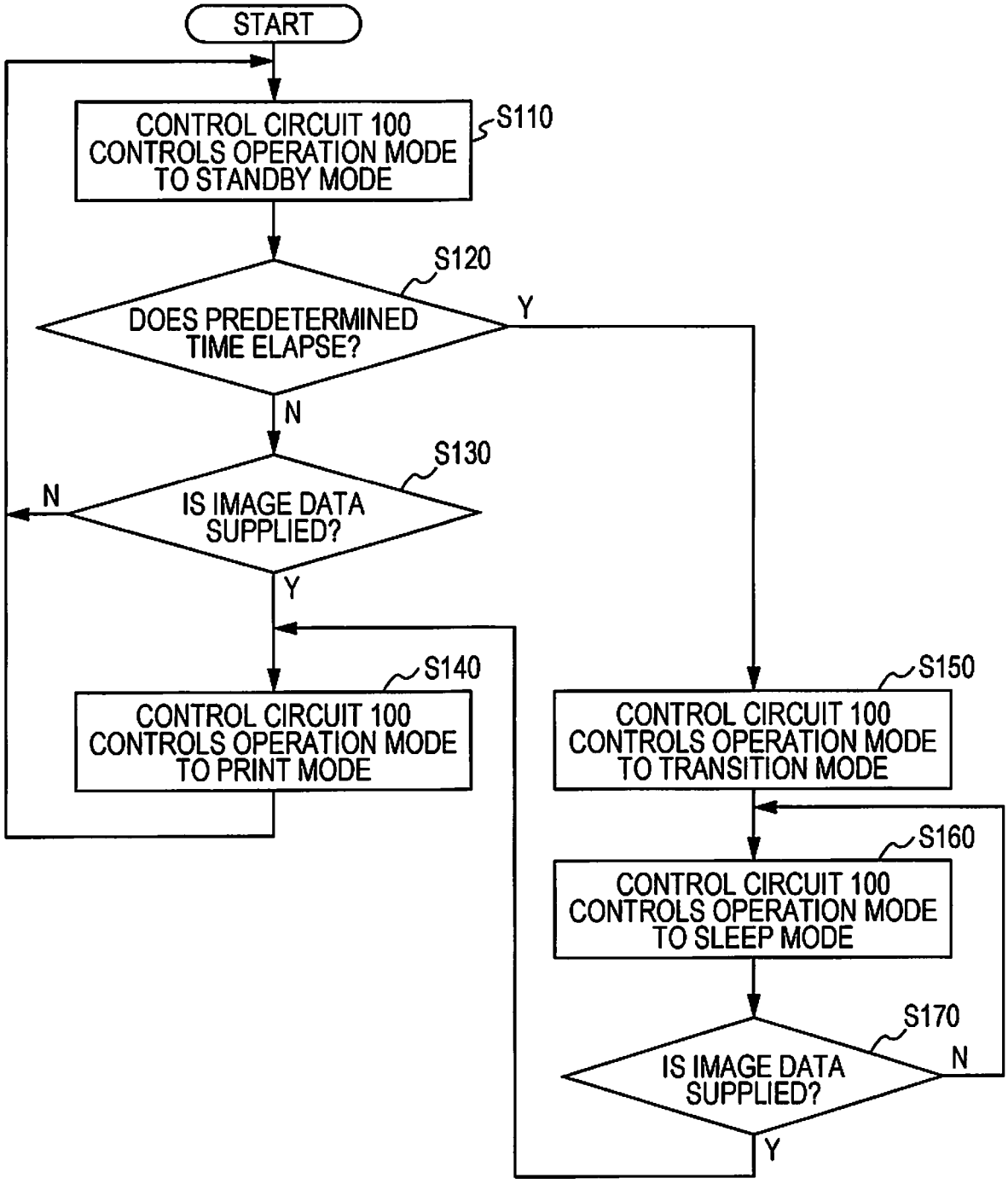
FIG. 3 is a flowchart illustrating a mode transition between operation modes of the liquid ejecting apparatus.

Here, a relationship between the operation modes of the liquid ejecting apparatus 1 described above will be described with reference to FIG. 3. FIG. 3 is a flowchart illustrating a mode transition of each operation mode of the liquid ejecting apparatus 1.

As illustrated in FIG. 3, if power is supplied to the liquid ejecting apparatus 1, the control circuit 100 controls an operation mode to become the standby mode (S110). After shifting to the standby mode, the control circuit 100 determines whether or not a predetermined time elapses (S120).

In a case where the predetermined time does not elapse (N of S120), the control circuit 100 determines whether image data is supplied to the liquid ejecting apparatus 1 (S130).

In a case where the image data is not supplied (N of S130), the standby mode is maintained. Meanwhile, in a case where the image data is supplied (Y of S130), the control circuit 100 controls an operation mode to become the print mode (S140).

In the print mode, if the printing corresponding to the supplied image data is completed, the control circuit 100 controls the operation mode to become the standby mode (S110).

In a case where the predetermined time elapses (Y of S120), the control circuit 100 controls the operation mode to become the transition mode (S150), and thereafter, controls the operation mode to become the sleep mode (S160).

After shifting to the sleep mode, the control circuit 100 determines whether or not the image data is supplied to the liquid ejecting apparatus 1 (S170).

In a case where the image data is not supplied (N of S170), the sleep mode is maintained. Meanwhile, in a case where the image data is supplied (Y of S170), the control circuit 100 controls the operation mode to become the print mode (S140).

In the first embodiment, the control circuit 100 outputs the state signals MC1 and MC2 indicating which of the print mode, the standby mode, the sleep mode, and the transition mode the liquid ejecting apparatus 1 is in. FIG. 4 is a diagram illustrating a relationship between the state signals MC1 and MC2 and each operation mode.

As illustrated in FIG. 4, in a case where the liquid ejecting apparatus 1 is in the print mode, the control circuit 100 outputs the state signals MC1 and MC2 at an H level. When the liquid ejecting apparatus 1 is in the standby mode, the control circuit 100 outputs the state signals MC1 and MC2 at H and L levels, respectively. When the liquid ejecting apparatus 1 is in the transition mode, the control circuit 100 outputs the state signals MC1 and MC2 at the L level. When the liquid ejecting apparatus 1 is in the sleep mode, the control circuit 100 outputs the state signals MC1 and MC2 at L and H levels, respectively.

The liquid ejecting apparatus 1 may include operation modes other than the above-described operation modes as the plurality of operation modes. For example, the liquid ejecting apparatus 1 may have operation modes such as a test print mode in which test printing is performed on the medium P, and a stop mode in which an operation stops due to running out of ink, poor transport of the medium P, or the like.

In the first embodiment, it is described that the operation modes of the liquid ejecting apparatus 1 are performed by using two signals of the state signals MC1 and MC2, but the control circuit 100 may perform the operation modes by using three or more signals, or may perform the operation modes by using a specific command.

1.2 Electrical Configuration of Drive Circuit

Figure 5:
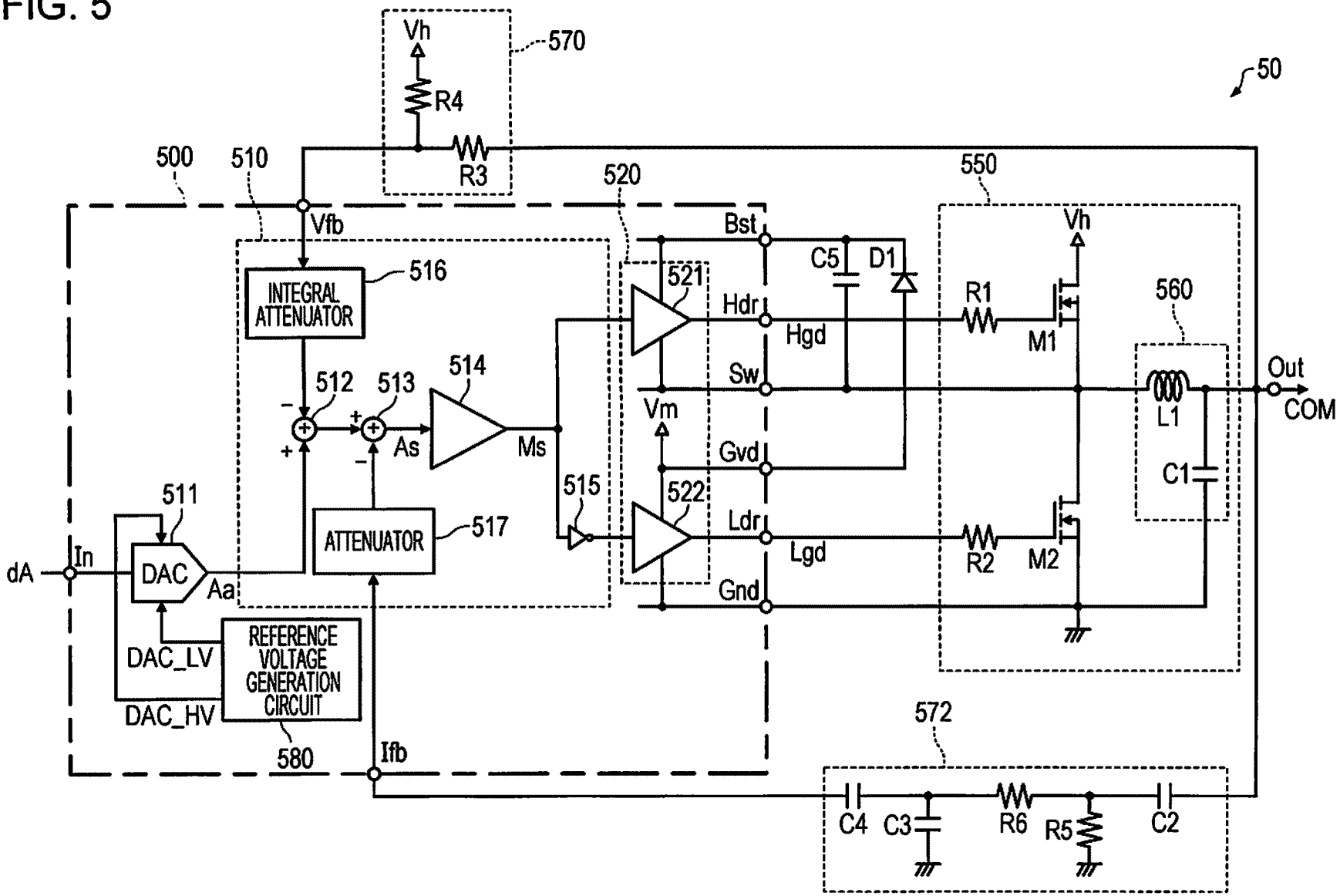
FIG. 5 is a diagram illustrating a circuit configuration of a drive circuit.

Next, the drive circuit 50 will be described in detail with reference to FIG. 5. FIG. 5 is a diagram illustrating a circuit configuration of the drive circuit 50. As illustrated in FIG. 5, the drive circuit 50 generates and outputs a drive signal COM for displacing a piezoelectric element 60 included in the head unit 20, based on data dA input from the control circuit 100.

The drive circuit 50 includes an integrated circuit 500, an output circuit 550, a first feedback circuit 570, a second feedback circuit 572, and a plurality of other circuit elements.

The integrated circuit 500 includes a digital to analog converter (DAC) 511, a modulation circuit 510, a gate driver 520, and a reference voltage generation circuit 580. In addition, the integrated circuit 500 is connected to various configurations outside the integrated circuit 500 via a plurality of terminals including a terminal In, a terminal Bst, a terminal Hdr, a terminal Sw, a terminal Gvd, a terminal Ldr, a terminal Gnd, a terminal Vfb, and a terminal Ifb.

The integrated circuit 500 modulates the data dA that defines a waveform of the drive signal COM input from the terminal In, and generates and outputs a first amplification control signal Hgd and a second amplification control signal Lgd for driving gates of a first transistor M1 and a second transistor M2 included in the output circuit 550.

The reference voltage generation circuit 580 generates a first reference voltage DAC_HV and a second reference voltage DAC_LV, and supplies the signals to the DAC 511.

The DAC 511 converts the data dA into an original drive signal Aa which is an analog signal having a voltage value between the first reference voltage DAC_HV and the second reference voltage DAC_LV. Then, the DAC 511 supplies the converted signal to an input terminal (+) of an adder 512 included in the modulation circuit 510.

The modulation circuit 510 includes the adder 512, an adder 513, a comparator 514, an inverter 515, an integral attenuator 516, and an attenuator 517.

The integral attenuator 516 attenuates and integrates a voltage of the drive signal COM input via the terminal Vfb, and supplies the attenuated and integrated voltage to an input terminal (−) of the adder 512.

The adder 512 subtracts a voltage which is output from the integral attenuator 516 and is input to the input terminal (−), from a voltage of the original drive signal Aa input to the input terminal (+), and supplies the integrated voltage to the input terminal (+) of the adder 513.

Here, there is a case where a maximum voltage of the drive signal COM exceeds 40 V, whereas a maximum voltage of the original drive signal Aa is approximately 2 V defined by the first reference voltage DAC_HV and the second reference voltage DAC_LV. Accordingly, the integral attenuator 516 attenuates the voltage of the drive signal COM in order to match amplitude ranges of both voltages when determining a deviation.

The attenuator 517 attenuates a high frequency component of the voltage of the drive signal COM input via the terminal Ifb and supplies the voltage to the input terminal (−) of the adder 513.

The adder 513 outputs a voltage signal As obtained by subtracting a voltage which is input to the input terminal (−) and is output from the attenuator 517, from a voltage which is input to the input terminal (+) and is output from the adder 512, to the comparator 514.

The voltage signal As output from the adder 513 is a voltage obtained by subtracting a voltage supplied to the terminal Vfb from a voltage of the original drive signal Aa, and by further subtracting a voltage supplied to the terminal Ifb. That is, it can be said that the voltage signal As is a voltage signal obtained by correcting a deviation obtained by subtracting an attenuation voltage of the output drive signal COM from the voltage of the original drive signal Aa which is a target, with a high frequency component of the drive signal COM.

The comparator 514 generates and outputs a modulation signal Ms, based on the input voltage signal As. Specifically, the comparator 514 generates the modulation signal Ms that goes to an H level when a voltage of the voltage signal As output from the adder 513 increases and in a case where the voltage of the voltage signal As increases to be higher than or equal to a threshold Vth1 which will be described below, and goes to an L level when the voltage of the voltage signal As output from the adder 513 decreases and in a case where the voltage of the voltage signal As decreases to be lower than or equal to a threshold Vth2 which will be described below. A relationship of threshold Vth1>threshold Vth2 is set.

Then, the comparator 514 outputs the generated modulation signal Ms to a first gate driver 521 included in the gate driver 520 which will be described below. In addition, the comparator 514 outputs the generated modulation signal Ms to a second gate driver 522 included in the gate driver 520 via the inverter 515. Thus, a signal supplied to the first gate driver 521 and a signal supplied to the second gate driver 522 have mutually exclusive logic levels.

Here, the fact that logic levels of the signals supplied to the first gate driver 521 and the second gate driver 522 are in an exclusive relationship means that timing is actually controlled so as not to simultaneously become an H level. That is, "exclusive" here includes a concept that the logic levels of the signals supplied to the first gate driver 521 and the second gate driver 522 do not simultaneously become the H level.

As described above, the modulation circuit 510 generates the modulation signal Ms, based on the original drive signal Aa (data dA) and a voltage of the drive signal COM fed back via the terminal Vfb and outputs the modulation signal to the output circuit 550 via the gate driver 520.

Here, the modulation signal is the modulation signal Ms in the narrow sense, but if it is considered that pulse-modulation is made according to the original drive signal Aa which is an analog signal based on the data dA which is a digital signal, a negative signal of the modulation signal Ms is also included in the modulation signal. That is, the modulation signal output from the modulation circuit 510 includes not only the above-described modulation signal Ms but also a signal obtained by inverting a logic level of the modulation signal Ms or timing-controlled signal.

In addition, a frequency and a duty ratio of the modulation signal Ms change according to the data dA (original drive signal Aa). Accordingly, as the attenuator 517 adjusts a modulation gain (sensitivity), the amount of change in the frequency and the duty ratio can be adjusted.

The gate driver 520 includes the first gate driver 521 and the second gate driver 522.

The first gate driver 521 shifts a level of the modulation signal Ms output from the comparator 514 and outputs the modulation signal from the terminal Hdr as a first amplification control signal Hgd. Among power supply voltages of the first gate driver 521, a high-level side is a voltage supplied via the terminal Bst, and a low-level side is a voltage supplied via the terminal Sw. The terminal Bst is connected to one end of a capacitor C5 and a cathode electrode of a diode D1 for preventing a back flow. The terminal Sw is connected to the other end of the capacitor C5. An anode electrode of the diode D1 is connected to the terminal Gvd, and a voltage Vm from a power supply circuit (not illustrated) is supplied to the terminal Gbd. Thus, a potential difference between the terminal Bst and the terminal Sw is approximately equal to a potential difference between both ends of the capacitor C5, that is, the voltage Vm. Then, the first gate driver 521 generates the first amplification control signal Hgd having a voltage larger by the voltage Vm with respect to the terminal Sw, according to the input modulation signal Ms, and outputs the first amplification control signal from the terminal Hdr to the outside of the integrated circuit 500.

The second gate driver 522 operates at a lower potential side than the first gate driver 521. The second gate driver 522 shifts a level of a signal obtained by inverting the modulation signal Ms output from the comparator 514 by using the inverter 515, and outputs the inverted signal as the second amplification control signal Lgd from the terminal Ldr. Among power supply voltages of the second gate driver 522, a high-level side is supplied with the voltage Vm, and a low-level side is supplied with a ground potential (0 V) via the terminal Gnd. The second gate driver 522 outputs a voltage larger by the voltage Vm to the terminal Gnd as the second amplification control signal Lgd from the terminal Ldr, according to the inverted signal of the input modulation signal Ms.

The output circuit 550 includes a first transistor M1, a second transistor M2, and a low pass filter 560. The output circuit 550 generates the drive signal COM by amplifying and demodulating the input modulation signal Ms. It can be said that the drive signal COM is obtained by amplifying the original drive signal Aa corresponding to the data dA, in other words, the data dA or the original drive signal Aa is an original signal from which the drive signal COM is derived.

A voltage Vh is supplied to a drain of the first transistor M1. A gate of the first transistor M1 is connected to one end of a resistor R1, and the other end of the resistor R1 is connected to the terminal Hdr of the integrated circuit 500. Thus, the first amplification control signal Hgd is supplied to the gate of the first transistor M1. A source of the first transistor M1 is connected to the terminal Sw of the integrated circuit 500.

A drain of the second transistor M2 is connected to the source of the first transistor M1. A gate of the second transistor M2 is connected to one end of a resistor R2, and the other end of the resistor R2 is connected to the terminal Ldr of the integrated circuit 500. Thus, the second amplification control signal Lgd is supplied to the gate of the second transistor M2. A source of the second transistor M2 is connected to the ground potential.

In the first transistor M1 and the second transistor M2 connected as described above, when the first transistor M1 is turned off and the second transistor M2 is turned on, a voltage at a connection point to which the terminal Sw is connected becomes the ground potential, and the voltage Vm is applied to the terminal Bst. Meanwhile, when the first transistor M1 is turned on and the second transistor M2 is turned off, a voltage at a connection point to which the terminal Sw is connected becomes a voltage Vh, and a voltage Vh+Vm is applied to the terminal Bst. That is, the first gate driver 521 that drives the first transistor M1 uses the capacitor C5 as a floating power supply, and changes a potential of the terminal Sw to 0 V or the voltage Vh, according to operations of the first transistor M1 and the second transistor M2, thereby, outputting the first amplification control signal Hgd in which an L level is the voltage Vh and an H level is voltage Vh+voltage Vm to the gate of the first transistor M1. Then, the first transistor M1 performs a switching operation, based on the first amplification control signal Hgd.

Since a potential of the terminal Gnd is fixed to the ground potential regardless of an operation of the first transistor M1 and the second transistor M2, the second gate driver 522 that drives the second transistor M2 outputs the second amplification control signal Lgd whose L level is 0 V and whose H level is the voltage Vm. The second transistor M2 performs a switching operation, based on the second amplification control signal Lgd.

As described above, the first transistor M1 and the second transistor M2 perform the switching operation in response to the first amplification control signal Hgd and the second amplification control signal Lgd based on the modulation signal Ms. By the switching operation of the first transistor M1 and the second transistor M2, an amplification modulation signal in which the modulation signal Ms is amplified based on the voltage Vh is generated at a connection point to which the source of the first transistor M1 and the drain of the second transistor M2 are connected. That is, the first transistor M1 and the second transistor M2 function as an amplification circuit. At this time, since the first amplification control signal Hgd and the second amplification control signal Lgd for driving the first transistor M1 and the second transistor M2 are in an exclusive relationship as described above, the first transistor M1 and the second transistor M2 are controlled so as not to be simultaneously turned on.

The low pass filter 560 includes an inductor L1 and a capacitor C1.

One end of the inductor L1 is commonly connected to the source of the first transistor M1 and the drain of the second transistor M2, and the other end is connected to a terminal Out from which the drive signal COM is output. The terminal Out is also connected to one end of the capacitor C1, and the other end of the capacitor C1 is connected to the ground potential.

Thereby, the inductor L1 and the capacitor C1 smoothen and demodulate an amplification modulation signal supplied to a connection point between the first transistor M1 and the second transistor M2, thereby, generating the drive signal COM.

As described above, the drive signal COM is generated by smoothening the amplification modulation signal amplified based on the voltage Vh. That is, the voltage Vh is a signal having a voltage value larger than a voltage of the drive signal COM and is an example of a third voltage signal.

The first feedback circuit 570 includes a resistor R3 and a resistor R4. One end of the resistor R3 is connected to the terminal Out, and the other end is connected to the terminal Vfb and one terminal of the resistor R4. The voltage Vh is applied to the other end of the resistor R4. Thereby, the drive signal COM passing through the first feedback circuit 570 from the terminal Out which is the output terminal of the drive circuit 50 is pulled up and is fed back to the terminal Vfb. That is, the first feedback circuit 570 is an example of a feedback circuit.

The second feedback circuit 572 includes capacitors C2, C3, C4 and resistors R5 and R6.

One end of the capacitor C2 is connected to the terminal Out, and the other end is connected to one end of the resistor R5 and one end of the resistor R6. The other end of the resistor R5 is connected to the ground potential. Thereby, the capacitor C2 and the resistor R5 function as a high pass filter. A cutoff frequency of the high pass filter formed by the capacitor C2 and the resistor R5 is set to, for example, approximately 9 MHz. The other end of the resistor R6 is connected to one end of the capacitor C4 and one end of the capacitor C3. The other end of the capacitor C3 is grounded. Thereby, the resistor R6 and the capacitor C3 function as a low pass filter. A cutoff frequency of the low-pass filter formed by the resistor R6 and the capacitor C3 is set to approximately, for example, 160 MHz. By configuring the high pass filter and the low pass filter in this manner, the second feedback circuit 572 functions as a band pass filter through which a predetermined frequency range of the drive signal COM passes.

The other end of the capacitor C4 is connected to the terminal Ifb of the integrated circuit 500. Thereby, among the high frequency components of the drive signal COM passing through the second feedback circuit 572 functioning as the band pass filter, a direct current component is cut off and fed back to the terminal Ifb. However, the drive signal COM is a signal obtained by smoothening the amplification modulation signal using the low pass filter 560. The drive signal COM is integrated and subtracted through the terminal Vfb, and thereafter, is fed back to the adder 512. Thus, self-excited oscillation occurs at a frequency determined by a feedback delay and a feedback transfer function. However, there is a case where since the amount of delay of a feedback path via the terminal Vfb is large, it is sometimes impossible to increase a self-excited oscillation frequency such that accuracy of the drive signal COM can sufficiently be ensured only by feedback via the terminal Vfb. Therefore, by providing a path for feeding back a high frequency component of the drive signal COM via the terminal Ifb separately from the path via the terminal Vfb, it is possible to reduce the delay as viewed from the entire circuit. Thereby, a frequency of the voltage signal As increases as an accuracy of the drive signal COM can be sufficiently secured, as compared with a case where there is no path through the terminal Ifb.

Figure 6:
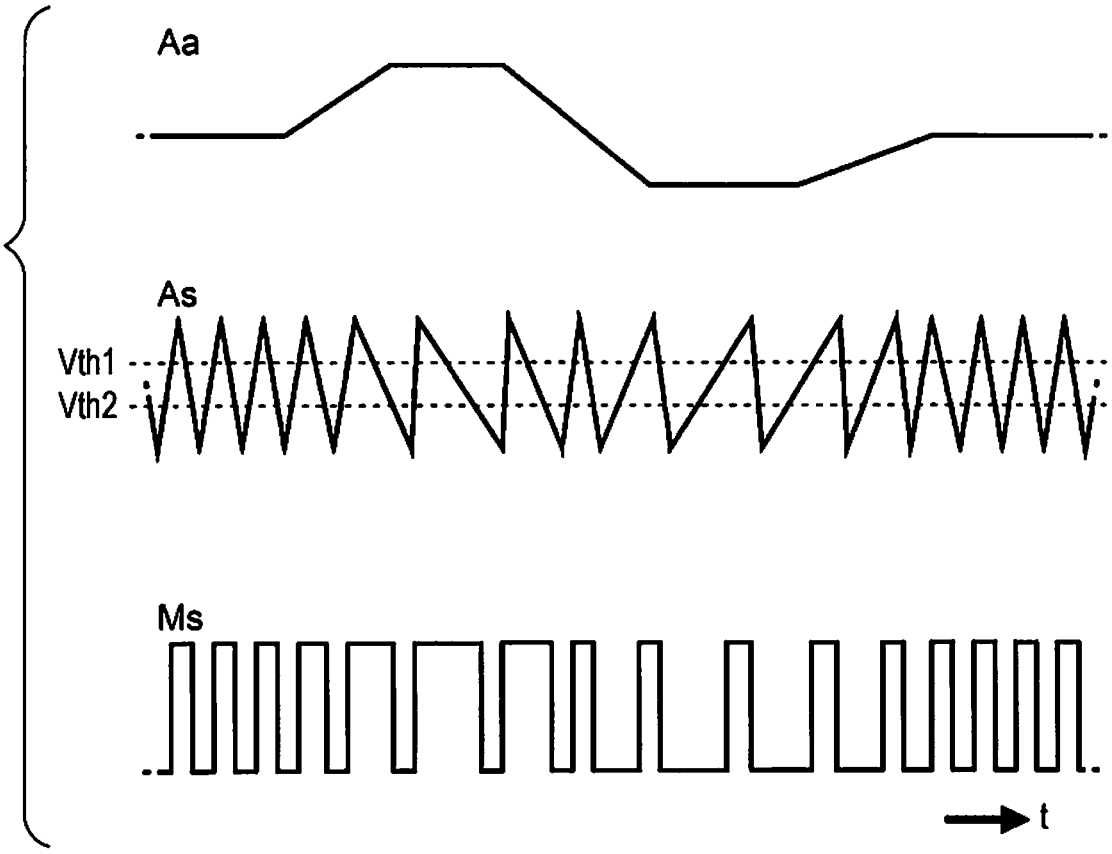
FIG. 6 is a diagram illustrating waveforms of a voltage signal and a modulation signal in association with waveform of an original drive signal.

FIG. 6 is a diagram illustrating waveforms of the voltage signal As and the modulation signal Ms in association with a waveform of the original drive signal Aa.

As illustrated in FIG. 6, the voltage signal As is a triangular wave, and an oscillation frequency thereof varies according to a voltage of the original drive signal Aa. Specifically, the voltage becomes the highest in a case where the voltage has an intermediate value, and the voltage decreases as the voltage increases or decreases from the intermediate value.

In addition, a slope of the triangular wave of the voltage signal As is substantially equal between a rise and a fall of the voltage if the voltage is near the intermediate value. Accordingly, a duty ratio of the modulation signal Ms obtained by comparing the voltage signal As with the thresholds Vth1 and Vth2 using the comparator 514 is approximately 50%. If the voltage of the voltage signal As increases from the intermediate value, a downward slope of the voltage signal As becomes gentle. Accordingly, a period during which the modulation signal Ms goes to an H level becomes relatively long, and z duty ratio of the modulation signal Ms increases. Meanwhile, if the voltage of the voltage signal As decreases from the intermediate value, an upward slope of the voltage signal As becomes gentle. Accordingly, the period during which the modulation signal Ms goes to an H level is relatively shortened, and the duty ratio of the modulation signal Ms decreases.

The first gate driver 521 turns on or off the first transistor M1, based on the modulation signal Ms. That is, the first gate driver 521 turns on the first transistor M1 if the modulation signal Ms is at an H level and turns off the first transistor M1 if the modulation signal Ms is at an L level. The second gate driver 522 turns on or off the second transistor M2, based on an inverted logic signal of the modulation signal Ms. That is, the second gate driver 522 turns off the second transistor M2 if the modulation signal Ms is at an H level and turns on the second transistor M2 if the modulation signal Ms is at an L level.

Thus, the voltage of the drive signal COM obtained by smoothening the amplification modulation signal using the inductor L1 and the capacitor C1 increases as the duty ratio of the modulation signal Ms increases, and decreases as the duty ratio decreases. Thus, the drive signal COM is controlled so as to be a signal obtained by increasing the voltage of the original drive signal Aa obtained by converting the data dA into the analog signal. When the duty ratio of the modulation signal Ms is kept constant, the drive signal COM becomes a constant voltage signal.

Since the drive circuit 50 uses a pulse density modulation, there is an advantage that a change width of the duty ratio can be increased with respect to a pulse width modulation in which a modulation frequency is fixed.

The minimum positive pulse width and negative pulse width that can be used in the drive circuit 50 are restricted by circuit features thereof. Accordingly, in a frequency-fixed pulse width modulation, only a predetermined range can be secured as a change width of the duty ratio. In contrast to this, in the pulse density modulation, the oscillation frequency decreases as the voltage of the voltage signal As moves away from the intermediate value, and the duty ratio can be more increased in a region where the voltage is high, and the duty ratio can be more reduced in a region where the voltage is low. Thus, in a self-excited oscillation type pulse density modulation, a wider range can be secured as the change width of the duty ratio.

As described above, the drive circuit 50 outputs the drive signal COM from the terminal Out which is an example of the output terminal. The drive signal COM is an example of the first voltage signal.

1.3 Configuration of Head Unit

Next, a configuration and an operation of the head unit 20 will be described. First, configurations of the recording head 21 and the ejection unit 600 provided in the recording head 21 will be described with reference to FIGS. 7 to 9. Next, an example of the drive signal COM and the reference voltage signal VBS supplied to the head unit 20 will be described with reference to FIGS. 10 and 11. The configuration and operation of the head unit 20 will be described below with reference to FIGS. 12 to 16.

Figure 7:
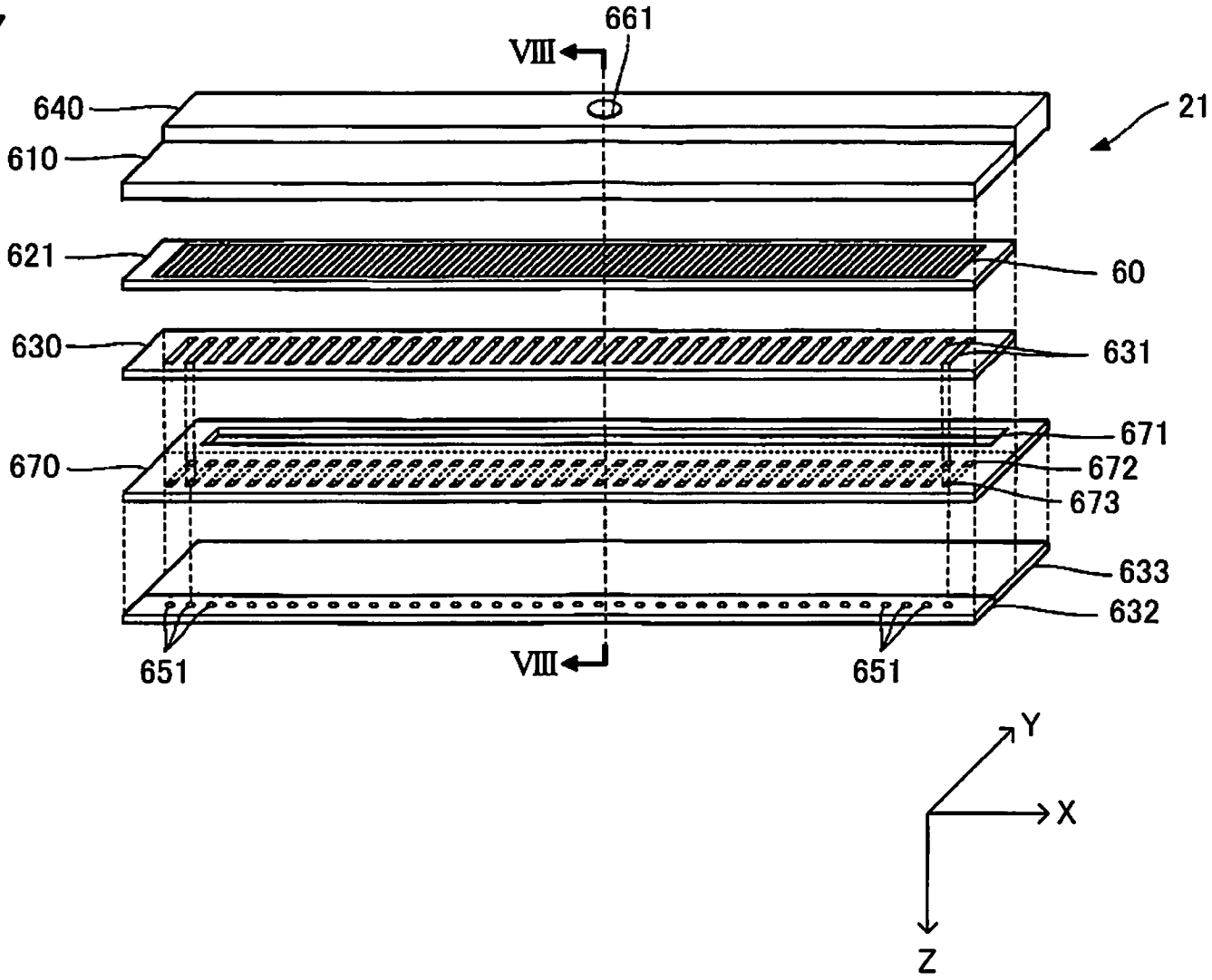
FIG. 7 is an exploded perspective view of a recording head.
Figure 8:
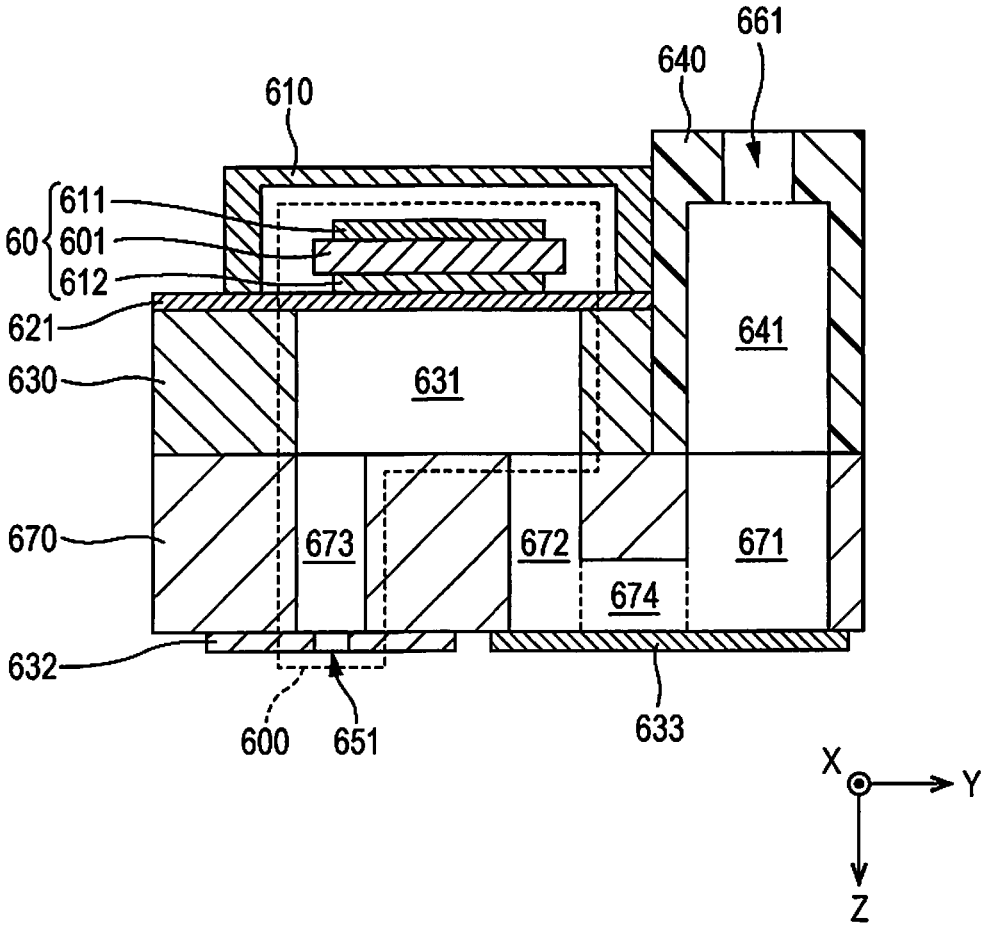
FIG. 8 is a sectional view illustrating a schematic configuration of an ejection unit.

FIG. 7 is an exploded perspective view of the recording head 21. FIG. 8 is a cross sectional view taken along a line VIII-VIII of FIG. 7 and is a cross sectional view illustrating a schematic configuration of the ejection unit 600.

As illustrated in FIGS. 7 and 8, the recording head 21 includes a substantially rectangular flow path substrate 670 elongated in the direction X. A pressure chamber substrate 630, a vibration plate 621, a plurality of piezoelectric elements 60, a housing portion 640, and a sealing body 610 are provided on one surface side of the flow path substrate 670 in the direction Z. A nozzle plate 632 and a vibration absorber 633 are provided on the other surface side of the flow path substrate 670 in the direction Z. Each configuration of the recording head 21 is a substantially rectangular member elongated in the direction X like the flow path substrate 670 and is bonded to each other by using an adhesive or the like.

As illustrated in FIG. 7, the nozzle plate 632 is a plate-like member in which a plurality of nozzles 651 are formed in parallel in the direction X. The nozzles 651 are provided in the nozzle plate 632 and are openings communicating with cavities 631 which will be described below.

The flow path substrate 670 is a plate-like member for forming a flow path of ink. As illustrated in FIGS. 7 and 8, an opening 671, supply flow paths 672, and communication flow paths 673 are formed in the flow path substrate 670. The opening 671 penetrates the flow path substrate in the direction Z and is an elongated through-hole that is formed in common in the plurality of nozzles 651 in the direction X. The supply flow path 672 and the communication flow path 673 are through-holes formed corresponding to each of the plurality of nozzles 651. Furthermore, as illustrated in FIG. 8, relay flow paths 674 formed in common in the plurality of supply flow paths 672 are provided on one surface of the flow path substrate 670 in the direction Z. The relay flow paths 674 connect the opening 671 to the plurality of supply flow paths 672.

The housing portion 640 is, for example, a structure manufactured by injection-molding a resin material, and is fixed to the other surface of the flow path substrate 670 in the direction Z. As illustrated in FIG. 8, the supply flow path 641 and a supply hole 661 are formed in the housing portion 640. The supply flow path 641 is a recess corresponding to the opening 671 of the flow path substrate 670, and the supply hole 661 is a through-hole that communicates with the supply flow path 641. A space in which the opening 671 of the flow path substrate 670 and the supply flow path 641 of the housing portion 640 communicate with each other functions as a reservoir for storing ink supplied from the supply hole 661.

The vibration absorber 633 is configured to absorb a pressure variation occurring inside the reservoir. Specifically, the vibration absorber 633 is fixed to one surface side of the flow path substrate 670 in the direction Z so as to form a bottom surface of the reservoir by closing the opening 671, the relay flow path 674, and the plurality of supply flow path 672 which are formed in the flow path substrate 670. The vibration absorber 633 is configured to include, for example, a compliance substrate which is a flexible sheet member that can be elastically deformed.

As illustrated in FIGS. 7 and 8, the pressure chamber substrate 630 is a plate-like member in which a plurality of cavities 631 corresponding to a plurality of nozzles 651 are formed. The plurality of cavities 631 are elongated in the direction Y, and are arranged side by side in the direction X. One end portion of the cavity 631 in the direction Y communicates with the supply flow path 672, and the other end portion of the cavity 631 in the direction Y communicates with the communication flow path 673.

As illustrated in FIGS. 7 and 8, the vibration plate 621 is fixed to a surface of the pressure chamber substrate 630 opposite to a surface to which the flow path substrate 670 is connected. The vibration plate 621 is an elastically deformable plate-like member. Specifically, as illustrated in FIG. 8, the flow path substrate 670 and the vibration plate 621 face each other at intervals inside each cavity 631. That is, the vibration plate 621 configures an upper surface which is a part of a wall surface of the cavity 631. As such, the cavity 631 is located between the flow path substrate 670 and the vibration plate 621, and functions as a pressure chamber that applies pressure to the ink filled in the cavity 631.

As illustrated in FIGS. 7 and 8, a plurality of piezoelectric elements 60 are provided on a surface of the vibration plate 621 opposite to the cavity 631. In other words, the vibration plate 621 is provided between the cavity 631 and the piezoelectric element 60. The plurality of piezoelectric elements 60 are arranged in the direction X so as to correspond to the plurality of cavities 631. As the vibration plate 621 vibrates in conjunction with the deformation of the piezoelectric element 60, the pressure inside the cavity 631 varies, and ink is ejected from the nozzle 651. Specifically, the piezoelectric element 60 is an actuator which is deformed by supplying the drive signal COM and is elongated in the direction Y. As illustrated in FIG. 8, the piezoelectric element 60 has a structure in which a piezoelectric body 601 is interposed between a pair of a first electrode 611 and a second electrode 612. The drive signal VOUT is supplied to the first electrode 611 and the reference voltage signal VBS is supplied to the second electrode 612. In this case, a central portion of the piezoelectric body 601 deforms in the vertical direction with respect to both end portions of the piezoelectric element 60 together with the vibration plate 621, according to a potential difference between the first electrode 611 and the second electrode 612. Ink is ejected from the nozzle 651, according to the deformation of the piezoelectric element 60. That is, the vibration plate 621 is displaced by the piezoelectric element 60 and functions as a diaphragm for enlarging/reducing an internal volume of the cavity 631 filled with the ink. Here, the reference voltage signal VBS supplied to the second electrode 612 of the piezoelectric element 60 is an example of a second voltage signal.

The sealing body 610 illustrated in FIGS. 7 and 8 protects a plurality of piezoelectric elements 60, reinforces mechanical strengths of the pressure chamber substrate 630 and the vibration plate 621, and is fixed to the vibration plate 621 by, for example, an adhesive. The plurality of piezoelectric elements 60 are contained inside a recess formed on a surface of the sealing body 610 facing the vibration plate 621.

Here, in the recording head 21, a configuration in which the piezoelectric element 60, the cavity 631, the vibration plate 621, and the nozzle 651 are included is the ejection unit 600.

Figure 9:
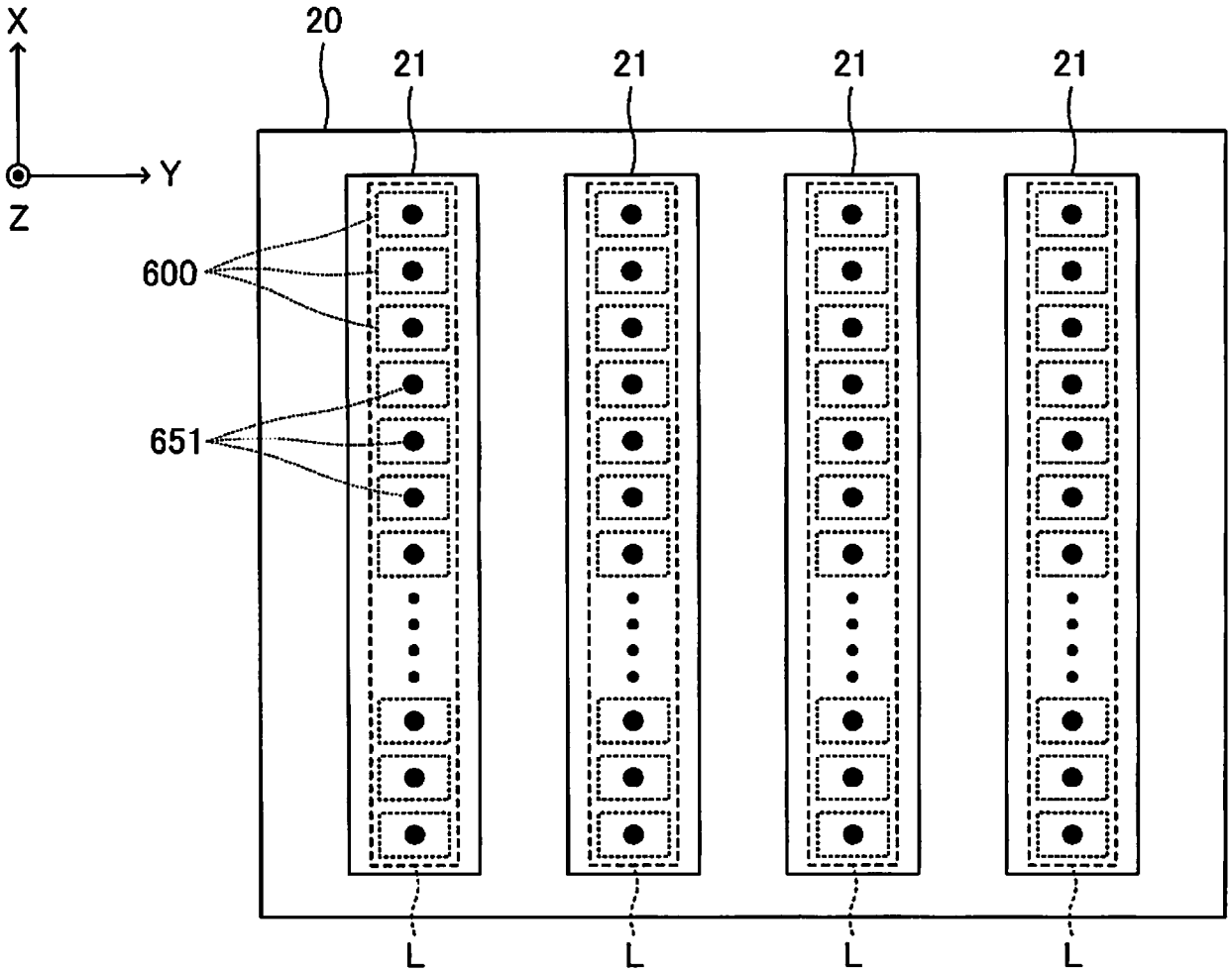
FIG. 9 is a diagram illustrating an example of arrangement of a plurality of nozzles provided in the recording head.

FIG. 9 is a view illustrating an example of the arrangement of the plurality of recording heads 21 included in the head unit 20 and the plurality of nozzles 651 provided in the recording head 21 in a plan view of the liquid ejecting apparatus 1 in the direction Z. In FIG. 9, description will be made by assuming that the head unit 20 includes four recording heads 21.

As illustrated in FIG. 9, in each recording head 21, a nozzle row L configured by the plurality of nozzles 651 arranged in a row in a predetermined direction is formed. In the first embodiment, each nozzle row L is formed by M nozzles 651 arranged in a row in the direction X.

The nozzle row L illustrated in FIG. 9 is an example and other configurations may be adopted. For example, in each nozzle row L, M nozzles 651 may be arranged in a staggered manner such that a location in the direction Y differs between the even-numbered nozzles 651 and the odd-numbered nozzles 651 which are counted from an end thereof. Each nozzle row L may be formed in a direction different from the direction X. In addition, in the first embodiment, the number of the nozzle rows L provided in each recording head 21 is exemplified as "1", but two or more nozzle rows L may be formed in each recording head 21.

Here, in the first embodiment, M nozzles 651 forming the nozzle row L are provided at a high density of 300 or more per inch in the recording head 21. Accordingly, in the recording head 21, M piezoelectric elements 60 are also provided at a high density corresponding to the M nozzles 651.

In the first embodiment, it is preferable that the piezoelectric body 601 used for the piezoelectric element 60 be a thin film having, for example, a thickness smaller than or equal to 1 μm. Thereby, the amount of displacement of the piezoelectric element 60 with respect to a potential difference between the first electrode 611 and the second electrode 612 can increase.

Next, the drive signal COM and the reference voltage signal VBS supplied to the piezoelectric element 60 will be described with reference to FIGS. 10 and 11.

Figure 10:
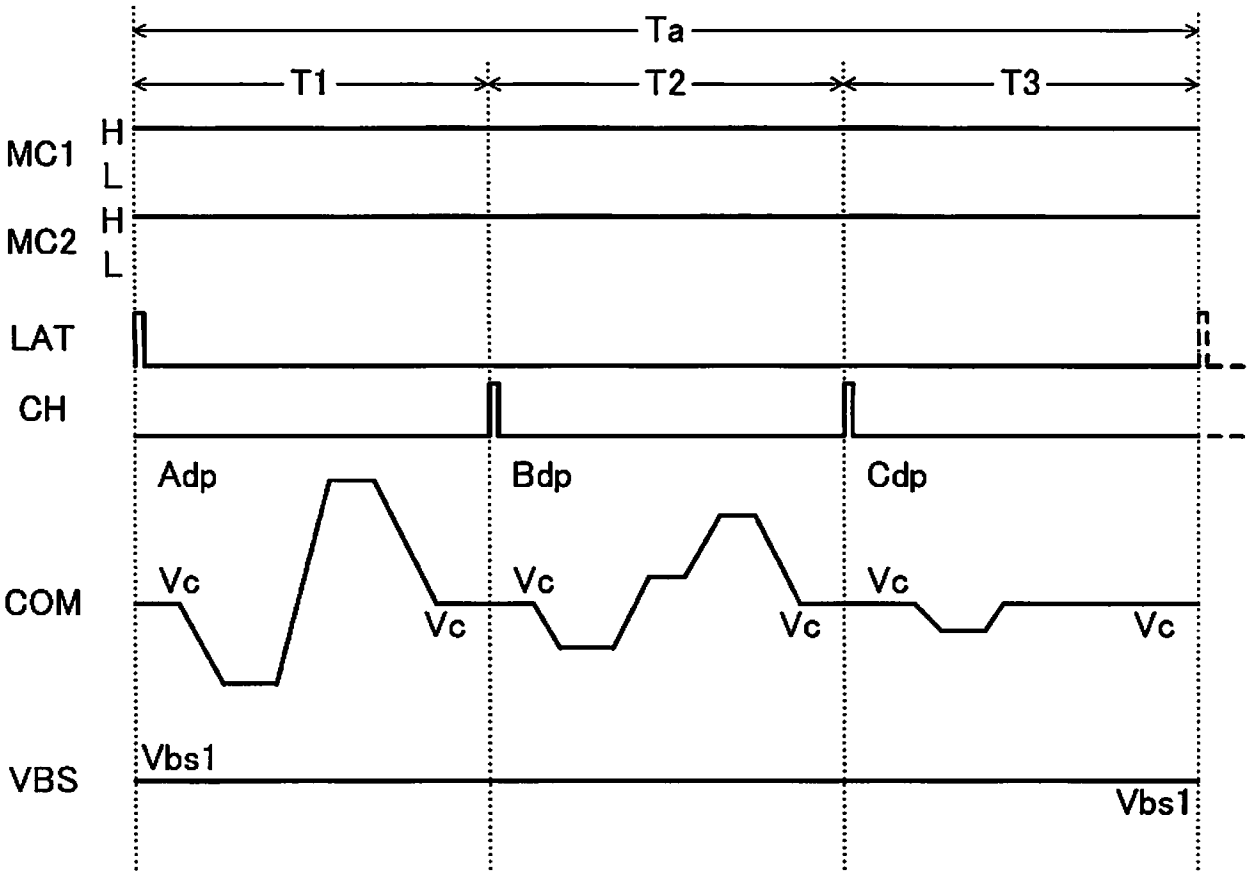
FIG. 10 is a diagram illustrating an example of a drive signal and a reference voltage signal in a print mode.

FIG. 10 is a diagram illustrating an example of the drive signal COM and the reference voltage signal VBS in the print mode. FIG. 10 illustrates a period T1 between a rise of the latch signal LAT and a rise of the change signal CH, a period T2 between the period T1 and a point of time when the next change signal CH rises, and a period T3 between the period T2 and a point of time when the latch signal LAT rises. A period configured by the periods T1, T2, and T3 is a cycle Ta in which new dots are formed on the medium P.

As illustrated in FIG. 10, in the print mode in which the state signals MC1 and MC2 are both at an H level, the drive circuit 50 generates a voltage waveform Adp in the period T1. Then, by supplying the voltage waveform Adp to the first electrode 611, the piezoelectric element 60 is displaced such that the predetermined amount of ink, specifically, the medium amount of ink is ejected from the corresponding nozzle 651. In addition, the drive circuit 50 generates a voltage waveform Bdp in the period T2. Then, by supplying the voltage waveform Bdp to the first electrode 611, the piezoelectric element 60 is displaced such that the small amount of ink smaller than the predetermined amount is ejected from the corresponding nozzle 651. In addition, the drive circuit 50 generates a voltage waveform Cdp in the period T3. Then by supplying the voltage waveform Cdp to the first electrode 611, the piezoelectric element 60 is displaced such that ink droplets are not ejected from the corresponding nozzle 651. Thus, dots are not formed on the medium P. The voltage waveform Cdp is a waveform for slightly vibrating the ink near the opening of the nozzle 651 to prevent a viscosity of the ink from increasing. A state in which the piezoelectric element 60 is displaced to an extent that ink droplets are not ejected from the corresponding nozzle 651 is referred to as "minute vibration". A voltage value at the start timing and a voltage value at the end timing of the voltage waveform Adp, the voltage waveform Bdp, and the voltage waveform Cdp are common as a voltage Vc. That is, the voltage waveform Adp, the voltage waveform Bdp, and the voltage waveform Cdp start at the voltage Vc and end at the voltage Vc. As described above, in the print mode, the drive circuit 50 outputs the drive signal COM in which the voltage waveform Adp, the voltage waveform Bdp, and the voltage waveform Cdp are consecutive in the cycle Ta.

In the print mode, the voltage generation circuit 70 generates and outputs the reference voltage signal VBS whose voltage value is a voltage Vbs1 in the cycle Ta. The reference voltage signal VBS functions as a reference voltage for the displacement of the piezoelectric element 60.

In each cycle Ta of the print mode, as the voltage waveform Adp is supplied to the first electrode 611 of the piezoelectric element 60 in the period T1 and the voltage waveform Bdp is supplied in the period T2, the medium amount of ink and the small amount of ink are ejected from the nozzle 651. Thereby, a "large dot" is formed on the medium P. In addition, as the voltage waveform Adp is supplied to the first electrode 611 of the piezoelectric element 60 in the period T1 and the voltage waveform Bdp is not supplied in the period T2, the medium amount of ink is ejected from the nozzle 651. Thereby, a "medium dot" is formed on the medium P. In addition, as the voltage waveform Adp is not supplied to the first electrode 611 of the piezoelectric element 60 in the period T1 and the voltage waveform Bdp is supplied in the period T2, the small amount of ink is ejected from the nozzle 651. Thereby, a "small dot" is formed on the medium P. In addition, as the voltage waveforms Adp and Bdp are not supplied to the first electrode 611 of the piezoelectric element 60 in the periods T1 and T2, and the voltage waveform Cdp is supplied in the period T3, the ink is not ejected from the nozzle 651 and the minute vibration occurs. At this time, dots are not formed on the medium P.

Figure 11:
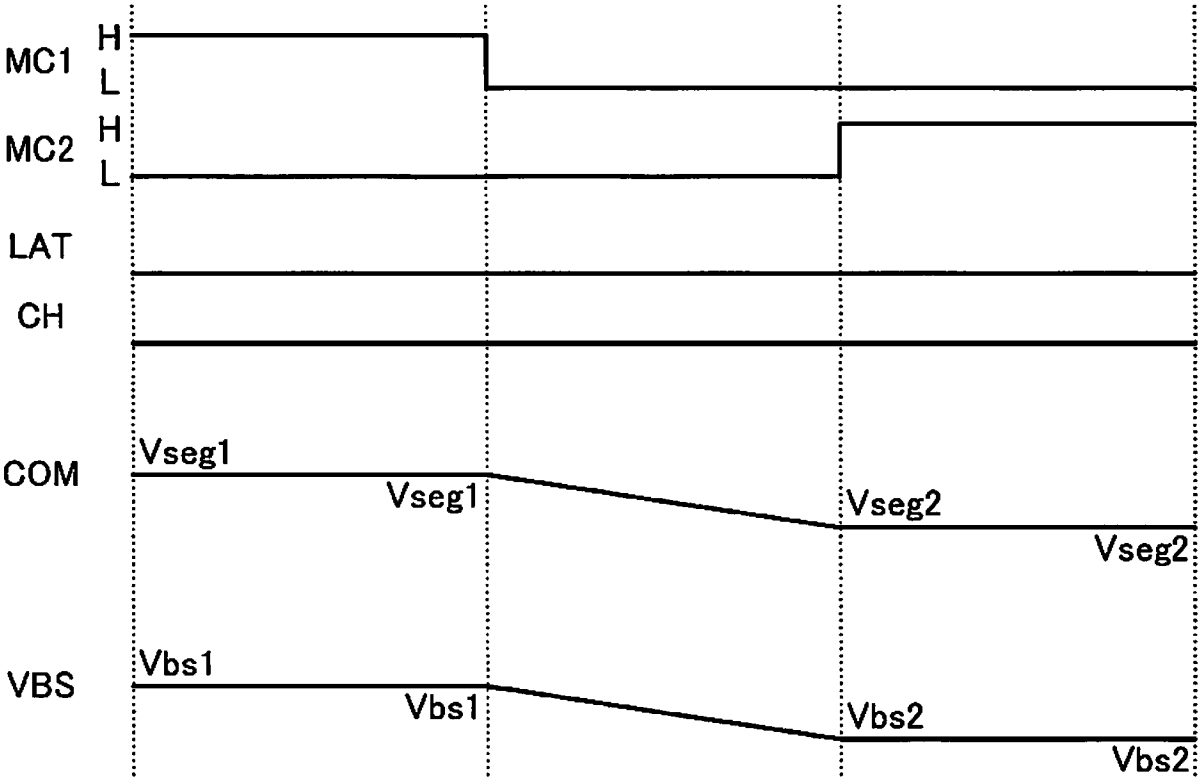
FIG. 11 is a diagram illustrating an example of the drive signal and the reference voltage signal in a standby mode, a transition mode, and a sleep mode.

FIG. 11 is a diagram illustrating an example of the drive signal COM and the reference voltage signal VBS in the standby mode, the transition mode, and the sleep mode. As illustrated in FIG. 11, in a case where the liquid ejecting apparatus 1 is in the standby mode, the transition mode, and the sleep mode, the latch signal LAT and the change signal CH are at an L level.

In the standby mode in which the state signals MC1 and MC2 are at an H level and an L level, respectively, the drive circuit 50 generates and outputs the drive signal COM whose voltage value is a voltage Vseg1. In the standby mode, the voltage generation circuit 70 generates and outputs the reference voltage signal VBS whose voltage value is the voltage Vbs1.

In the sleep mode in which the state signals MC1 and MC2 are at an L level and an H level, respectively, the drive circuit 50 generates and outputs the drive signal COM whose voltage value is a voltage Vseg2. In the sleep mode, the voltage generation circuit 70 generates and outputs the reference voltage signal VBS whose voltage value is a voltage Vbs2.

In the transition mode in which the state signals MC1 and MC2 are both at an L level, the drive circuit 50 generates and outputs the drive signal COM whose voltage value changes from the voltage Vseg1 to the voltage Vseg2. In the transition mode, the voltage generation circuit 70 generates and outputs the reference voltage signal VBS whose voltage value changes from the voltage Vbs1 to the voltage Vbs2.

Here, as will be described in detail below, in the standby mode, the transition mode, and the sleep mode, a voltage value of the drive signal COM is controlled to approximate a voltage value of the reference voltage signal VBS. That is, the voltage Vseg1, which is the voltage value of the drive signal COM in the standby mode, is controlled to approximate the voltage Vbs1 which is the voltage value of the reference voltage signal VBS in the standby mode. The voltage Vseg2, which is the voltage value of the drive signal COM in the sleep mode, is controlled to approximate the voltage Vbs2 which is the voltage value of the reference voltage signal VBS in the sleep mode. In the transition mode, the voltage value of the reference voltage signal VBS changes from the voltage Vbs1 to the voltage Vbs2, and the voltage value of the drive signal COM changes from the voltage Vseg1 to the voltage Vseg2 so as to approximate the change of the voltage value of the reference voltage signal VBS. In other words, in the standby mode, the transition mode, and the sleep mode, z potential difference between the first electrode 611 and the second electrode 612 of the piezoelectric element 60 is controlled so as to be small. Thus, in the standby mode, the transition mode, and the sleep mode, the displacement of the piezoelectric element 60 is small and ink is not ejected from the nozzle 651.

Figure 12:
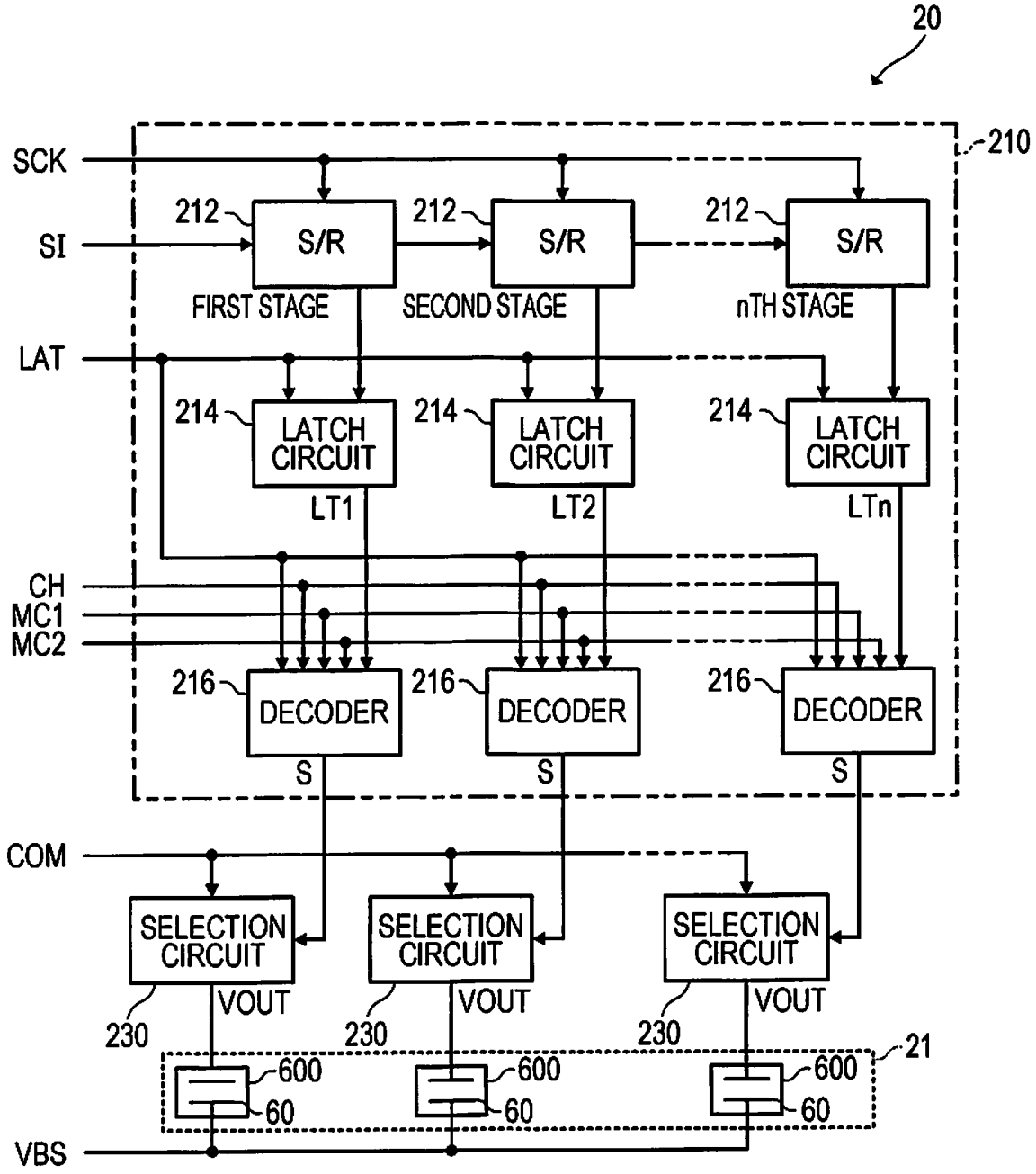
FIG. 12 is a diagram illustrating an electrical configuration of a head unit.

FIG. 12 is a diagram illustrating an electrical configuration of the head unit 20. As illustrated in FIG. 12, the head unit 20 includes the selection control circuit 210, the plurality of selection circuits 230, and the recording head 21.

The selection control circuit 210 receives the clock signal SCK, the print data signal SI, the state signals MC1 and MC2, the latch signal LAT, and the change signal CH. The selection control circuit 210 includes a set of a shift register 212 (S/R), a latch circuit 214, and a decoder 216 corresponding to each of the ejection units 600. That is, the number of sets of the shift register 212, the latch circuit 214, and the decoder 216 included in the head unit 20 is the same as the total number n of the ejection units 600 included in the head unit 20.

The shift register 212 is configured to temporarily hold print data [SIR, SIL] of two bits included in the print data signal SI for each corresponding ejection unit 600.

In detail, the shift register 212 having the number of stages corresponding to the ejection units 600 is connected in cascade, and the serially supplied print data signal SI is sequentially transmitted to a subsequent stage in accordance with the clock signal SCK. In FIG. 12, in order to distinguish the shift register 212, it is denoted as a first stage, a second stage, . . . , an nth stage sequentially from an upstream side to which the print data signal SI is supplied.

Each of the n latch circuits 214 latches the print data [SIH, SIL] held by each of the n shift registers 212 at a leading edge of the latch signal LAT.

Each of the n decoders 216 decodes the print data [SIH, SIL] of two bits latched by each of the n latch circuits 214 and the state signals MC1 and MC2 to generate a selection signal S, and outputs the generated selection signal to the selection circuit 230.

The selection circuit 230 is provided corresponding to each of the ejection units 600. That is, the number of selection circuits 230 included in one head unit 20 is the same as the total number n of nozzles 651 included in the head unit 20. The selection circuit 230 selects the drive signal COM, based on the input selection signal S.

Figure 13:
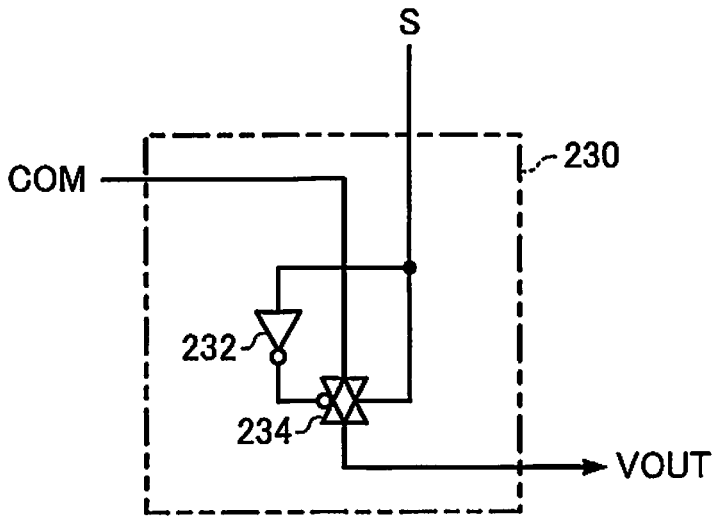
FIG. 13 is a diagram illustrating a configuration of a selection circuit.

FIG. 13 is a diagram illustrating a configuration of the selection circuit 230 corresponding to one ejection unit 600. As illustrated in FIG. 13, the selection circuit 230 includes an inverter 232 (NOT circuit) and a transfer gate 234 which is an example of a first switch element.

The selection signal S output from the decoder 216 is supplied to a positive control terminal which is not marked with a circle at the transfer gate 234. The selection signal S is logically inverted by the inverter 232 and is also supplied to a negative control terminal which is marked with a circle in the transfer gate 234.

The transfer gate 234 is electrically connected to the terminal Out of the drive circuit 50 and the first electrode 611 of the piezoelectric element 60, the drive signal COM is supplied to an input terminal thereof, and a voltage signal generated in an output terminal thereof is supplied to the ejection unit 600 as the drive signal VOUT.

If the selection signal S is at an H level, the transfer gate 234 connects (on) an input terminal thereof to an output terminal thereof, and if the selection signal S is at an L level, the transfer gate 234 does not connect (off) the input terminal to the output terminal.

Here, the decoding content of the decoder 216 according to the first embodiment will be described with reference to FIG. 14. FIG. 14 is a diagram illustrating the decoded content of the decoder 216.

The print data [SIH, SIL] of two bits, the state signals MC1 and MC2, the latch signal LAT, and the change signal CH output from the latch circuit 214 are input to the decoder 216.

In a case of the print mode in which both the state signals MC1 and MC2 are at an H level, the decoder 216 outputs the selection signal S of a logic level based on the print data [SIH, SIL] in each of the periods T1, T2, and T3 defined by the latch signal LAT and the change signal CH.

Specifically, in a case where the print data [SIH, SIL] is [1, 1] defining a "large dot", the decoder 216 outputs the selection signals S of H, H, and L levels in each of the periods T1, T2, and T3. In a case where the print data [SIH, SIL] is [1, 0] defining a "medium dot", the decoder 216 outputs the selection signals S of H, L, and L levels in each of the periods T1, T2, and T3. In a case where the print data [SIH, SIL] is [0, 1] defining a "small dot", the decoder 216 outputs the selection signals S of L, H, and L levels in each of the periods T1, T2, and T3. In a case where the print data [SIH, SIL] is [0, 0] defining the "minute vibration", the decoder 216 outputs the selection signals S of L, L, and H levels in each of the periods T1, T2, and T3.

In addition, the decoder 216 determines a logic level of the selection signal S regardless of the print data [SIH, SIL] and the periods T1, T2, and T3 in the standby mode, the transition mode, and the sleep mode.

Specifically, in a case where each of the state signals MC1 and MC2 is in the standby mode of H and L levels, the decoder 216 outputs the selection signal S of an H level. In a case where each of the state signals MC1 and MC2 is in the transition mode of an L level in common, the decoder 216 outputs the selection signal S of an H level. In a case where each of the state signals MC1 and MC2 is in the sleep mode of L and H levels, the decoder 216 outputs the selection signal S of an L level.

In the head unit 20 described above, an operation in which the drive signal VOUT is supplied to the ejection unit 600 will be described with reference to FIGS. 15 and 16.

Figure 15:
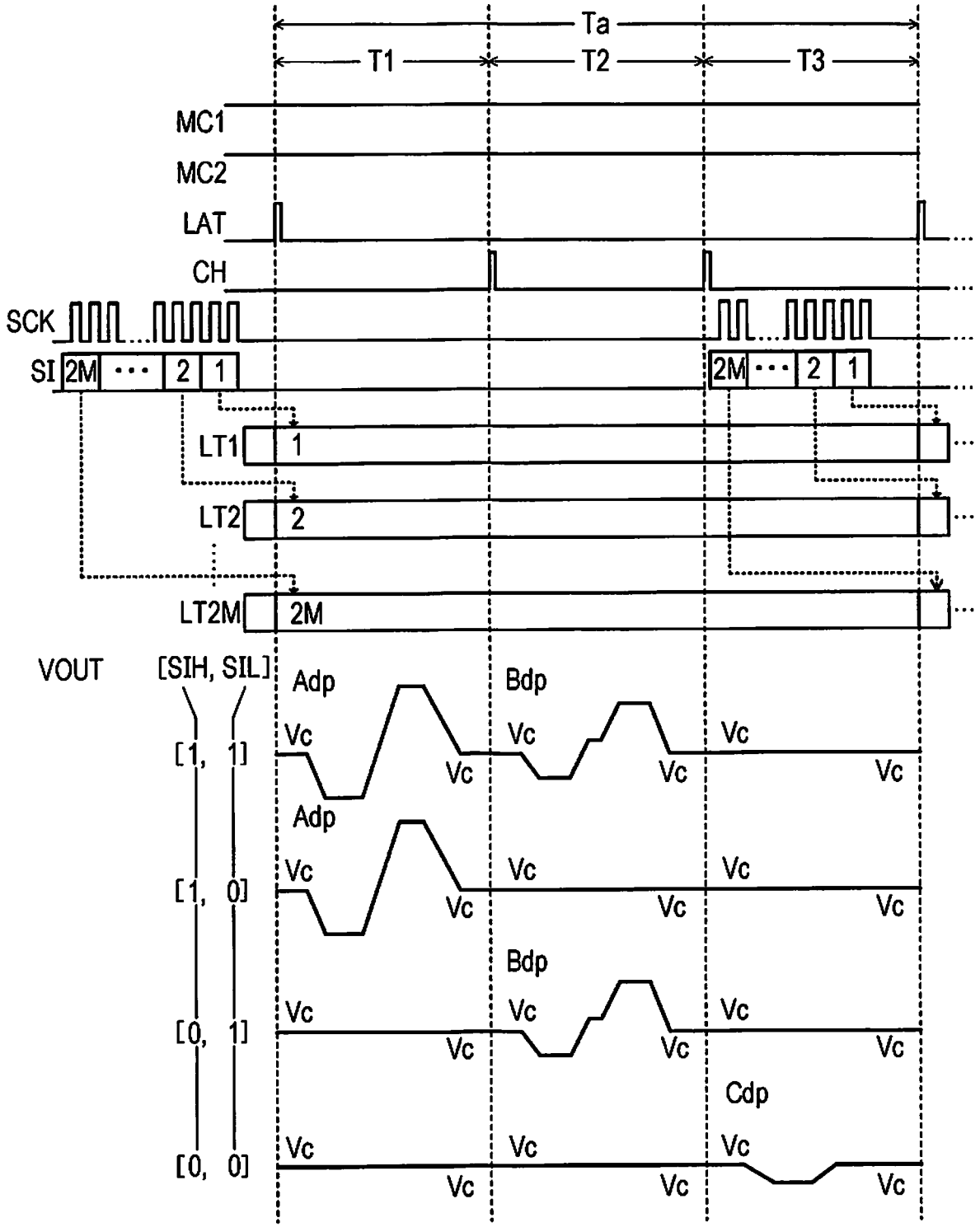
FIG. 15 is a diagram illustrating an operation of the head unit in the print mode.

FIG. 15 is a diagram illustrating the operation of the head unit 20 in the print mode.

In the print mode, the print data signal SI is serially supplied in synchronization with the clock signal SCK, and is sequentially transmitted to the shift registers 212 corresponding to the nozzles 651. If supplying the clock signal SCK is stopped, the print data [SIH, SIL] corresponding to the nozzles 651 is held in each of the shift registers 212. The print data signal SI is supplied to the shift registers in the order of the last nth stage, . . . , the second stage, and the first stage of the shift registers 212 corresponding to the nozzles 651.

Here, if the latch signal LAT rises, each of the latch circuits 214 latches the print data [SIH, SIL] held in the corresponding shift register 212 all at once. In FIG. 15, LT1, LT2, . . . , LTn indicate print data [SIH, SIL] latched by the latch circuit 214 corresponding to the shift registers 212 of the first stage, the second stage, . . . , the nth stage.

The decoder 216 outputs the selection signals S of the logic levels according to the content illustrated in FIG. 14, in each of the periods T1, T2, and T3, depending on a size of the dot defined by the latched print data [SIH, SIL].

In a case where the print data [SIH, SIL] is [1, 1], the selection circuit 230 selects the voltage waveform Adp in the period T1, selects the voltage waveform Bdp in the period T2, and does not select the voltage waveform Cdp in the period T3, according to the selection signal S. As a result, the drive signal VOUT corresponding to the large dot illustrated in FIG. 15 is supplied to the ejection unit 600.

In a case where the print data [SIH, SIL] is [1, 0], the selection circuit 230 selects the voltage waveform Adp in the period T1, does not select the voltage waveform Bdp in the period T2, and does not select the voltage waveform Cdp in the period T3, according to the selection signals S. As a result, the drive signal VOUT corresponding to the medium dot illustrated in FIG. 15 is supplied to the ejection unit 600.

In a case where the print data [SIH, SIL] is [0, 1], the selection circuit 230 does not select the voltage waveform Adp in the period T1, selects the voltage waveform Bdp in the period T2, and does not select the voltage waveform Cdp in the period T3, according to the selection signals S. As a result, the drive signal VOUT corresponding to the small dot illustrated in FIG. 15 is supplied to the ejection unit 600.

In a case where the print data [SIH, SIL] is [0, 0], the selection circuit 230 does not select the voltage waveform Adp in the period T1, does not select the voltage waveform Bdp in the period T2, and selects the voltage waveform Cdp in the period T3, according to the selection signals S. As a result, the drive signal VOUT corresponding to the minute vibration illustrated in FIG. 15 is supplied to the ejection unit 600.

Figure 16:
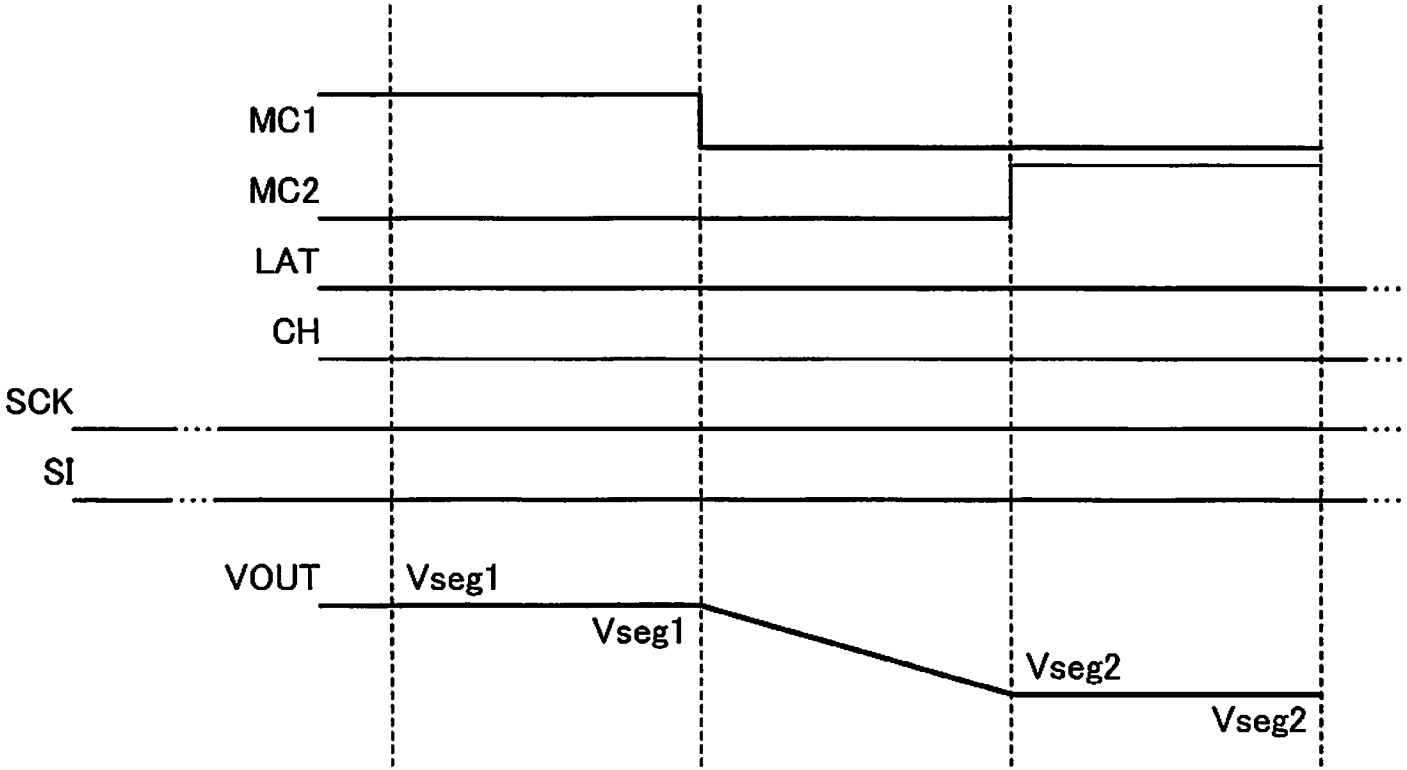
FIG. 16 is a view illustrating the operation of the head unit in the standby mode, the transition mode, and the sleep mode.

FIG. 16 is a diagram illustrating operations of the head unit 20 in the standby mode, the transition mode, and the sleep mode.

Since printing is not performed in the standby mode, the transition mode, and the sleep mode, the latch signal LAT, the change signal CH, the clock signal SCK, and the print data signal SI are at an L level in the first embodiment. Thus, the shift register 212 and the latch circuit 214 do not operate.

As illustrated in FIG. 14, in the standby mode, the transition mode, and the sleep mode, the decoder 216 determines the logic levels of the selection signals S, according to the state signals MC1 and MC2. In a case where the state signals MC1 and MC2 are in the standby mode of H and L levels, the selection circuit 230 selects the drive signal COM whose voltage value is the voltage Vseg1, according to the input selection signal S of H level. As a result, the drive signal VOUT whose voltage value is the voltage Vseg1 is supplied to the ejection unit 600.

In a case where the state signals MC1 and MC2 are in shift mode of an L level in common, the selection circuit 230 selects the drive signal COM whose voltage value changes from the voltage Vseg1 to the voltage Vseg2, according to the input selection signal S of an H level. As a result, the drive signal VOUT whose voltage value changes from the voltage Vseg1 to the voltage Vseg2 is supplied to the ejection unit 600.

In a case where the state signals MC1 and MC2 are in the sleep mode of L and H levels, respectively, the selection circuit 230 does not select the drive signal COM whose voltage value is the voltage Vseg2, according to the input selection signal S of an L level. As a result, the drive signal VOUT holds a voltage value just before the transition mode is changed to the sleep mode, that is, the voltage Vseg2.

As described above, in the print mode according to the first embodiment, ink is ejected from the nozzle 651, and a voltage value of the reference voltage signal VBS is controlled to be the voltage Vbs1. In the standby mode according to the first embodiment, the ink is not ejected from the nozzle 651, the voltage value of the reference voltage signal VBS is controlled to be the voltage Vbs1, a voltage value of the drive signal COM is controlled to be the voltage Vseg1 so as to approximate the voltage Vbs1, and the transfer gate 234 is controlled so as to be turned on. In the transition mode according to the first embodiment, the ink is not ejected from the nozzle 651, a voltage value of the reference voltage signal VBS is controlled to be the voltage Vbs2 lower than the voltage Vbs1 from the voltage Vbs1, and the voltage value of the drive signal COM is controlled to be the voltage Vseg2 from the voltage Vseg1 so as to approximate the voltage value of the reference voltage signal VBS and the transfer gate 234 is controlled to be turned on. In the sleep mode according to the first embodiment, the ink is not ejected from the nozzle 651, the voltage value of the reference voltage signal VBS is controlled so as to be the voltage Vbs2 lower than the voltage Vbs1, the voltage value of the drive signal COM is controlled to be the voltage Vseg2 so as to approximate the voltage value of the reference voltage signal VBS, and the transfer gate 234 is controlled to be turned off.

Here, the voltage Vbs1 is an example of a first voltage and the voltage Vbs2 is an example of a second voltage. The print mode is an example of a first mode according to the first embodiment, and the transition mode is an example of a second mode according to the first embodiment.

1.4 Operation of Liquid Ejecting Apparatus in Standby Mode, Transition Mode, and Sleep Mode There is a possibility that the standby mode, the transition mode, and the sleep mode may continue for a longer time than the print mode. Accordingly, in the operation mode, in a case where an unintended voltage is applied to the piezoelectric element 60 and the piezoelectric element 60 is held in a state of being largely displaced, stress based on the displacement is continuously applied to the vibration plate 621 for a long time, and thereby, a crack or the like can occur in the vibration plate 621 due to the stress. In a case where the piezoelectric element 60 is held in a displaced state in the operation mode, an unnecessary load is applied to the vibration plate 621 after transition to the print mode is performed, and the crack or the like may occur in the vibration plate 621 due to the load.

Specifically, as described above, the piezoelectric element 60 is displaced by a potential difference between the first electrode 611 and the second electrode 612. Accordingly, in a case where an unintended voltage is supplied to either the first electrode 611 or the second electrode 612, an unintended displacement occurs in the piezoelectric element 60. The unintended displacement occurring in the piezoelectric element 60 may cause unintended stress in the piezoelectric element 60 and the vibration plate 621.

Figure 17A:
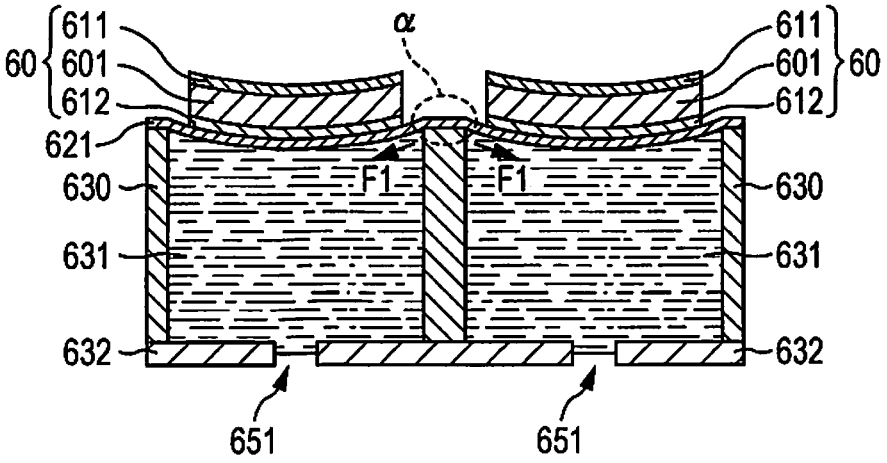
FIGS. 17A and 17B are diagrams illustrating displacements of a piezoelectric element and a vibration plate and stress occurring in the vibration plate in a case where an unintended voltage is supplied to the piezoelectric element.
Figure 17B:
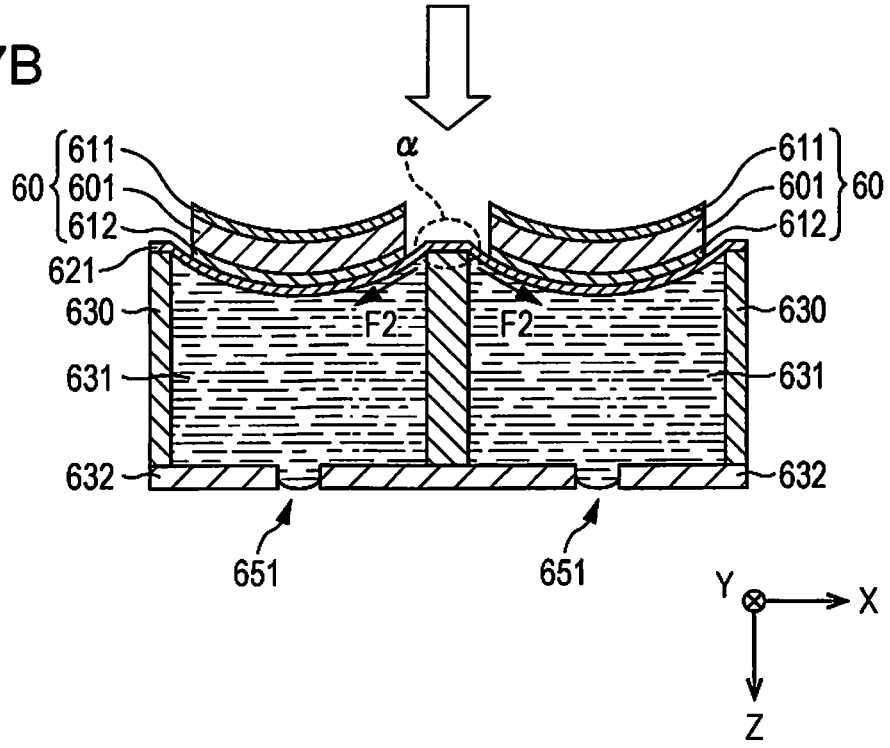

FIGS. 17A and 17B are diagrams illustrating the displacement of the piezoelectric element 60 and the vibration plate 621, and the stress occurring in the vibration plate 621 in a case where the unintended voltage is supplied to the piezoelectric element 60. FIGS. 17A and 17B are sectional views in a case where two of each of the plurality of piezoelectric elements 60, the cavities 631, and the nozzles 651 included in the recording head 21 are viewed in the direction Y. FIG. 17A illustrates the displacements of the piezoelectric element 60 and the vibration plate 621 in a case where predetermined voltages are supplied to both the first electrode 611 and the second electrode 612. FIG. 17B illustrates the displacements of the piezoelectric element 60 and the vibration plate 621 in a case where an unintended voltage is supplied to one of the first electrode 611 and the second electrode 612.

As illustrated in FIG. 17A, in a case where the predetermined voltages are supplied to both the first electrode 611 and the second electrode 612, a potential difference within an assumed range is generated between the first electrode 611 and the second electrode 612. Thus, the piezoelectric element 60 is displaced within the assumed range, and likewise, the vibration plate 621 is displaced within the assumed range. At this time, a stress F1 within the assumed range occurs at a contact point α between the vibration plate 621 and the cavity 631.

Meanwhile, as illustrated in FIG. 17B, in a case where an unintended voltage is supplied to one of the first electrode 611 and the second electrode 612, a potential difference within the assumed range may be generated between the first electrode 611 and the second electrode 612. Thus, the displacement out of the assumed range may be generated in the piezoelectric element 60, and likewise the displacement out of the assumed range may occur in the vibration plate 621. At this time, there is a case where a stress F2 greater than an expected stress occurs intensively at the contact point α between the vibration plate 621 and the cavity 631.

In addition, the stress occurring at the contact point between the vibration plate 621 and the cavity 631 may be different depending on a location of a contact point between the vibration plate 621 and the cavity 631 in the direction Y. Specifically, the stress occurring at the contact point between the vibration plate 621 and the cavity 631 is larger than the stress at a point which is the contact point between the vibration plate 621 and the cavity 631 and in which the displacement of the vibration plate 621 in the direction Z becomes maximum.

Figure 18:
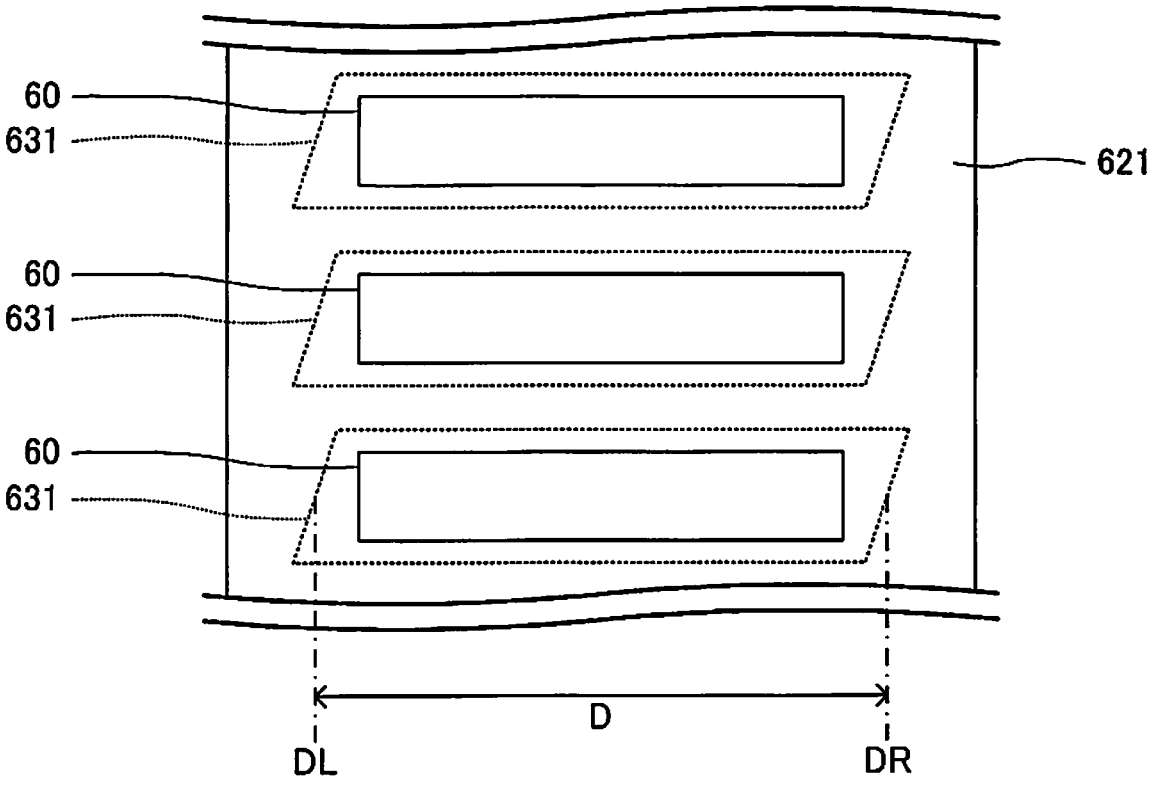
FIG. 18 is a plan view in a case where the vibration plate is viewed from a direction Z.

A factor of the displacement occurring in the vibration plate 621 includes, for example, natural vibration occurring in the vibration plate 621. FIG. 18 is a plan view in a case where the vibration plate 621 is viewed from the direction Z. As illustrated in FIG. 18, the cavity 631 according to the first embodiment has an elongated shape in the direction Y, and the natural vibration in the direction Y may occur in the vibration plate 621 in some cases. The natural vibration occurs in a vibration region D between a first contact point DL where the vibration plate 621 and the cavity 631 are in contact with each other and a second contact point DR.

Figure 19:
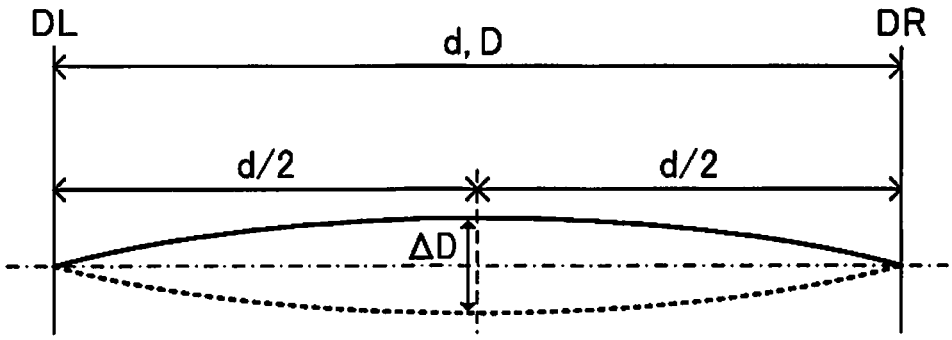
FIG. 19 is a diagram exemplifying a case where a first natural vibration occurs in the vibration plate.

FIG. 19 is a diagram exemplifying a case where a primary natural vibration occurs in the vibration plate 621. As illustrated in FIG. 19, in a case where the primary natural vibration occurs in the vibration plate 621, a displacement ΔD of the vibration plate 621 caused by the natural vibration is maximum at the center of the vibration region D. Specifically, in a case where a distance from the first contact point DL to the second contact point DR is referred to as d in the vibration region D, the displacement ΔD of the vibration plate 621 is maximum at a point where a distance from the first contact point DL is d/2 and a distance from the second contact point DR is d/2.

Figure 20:
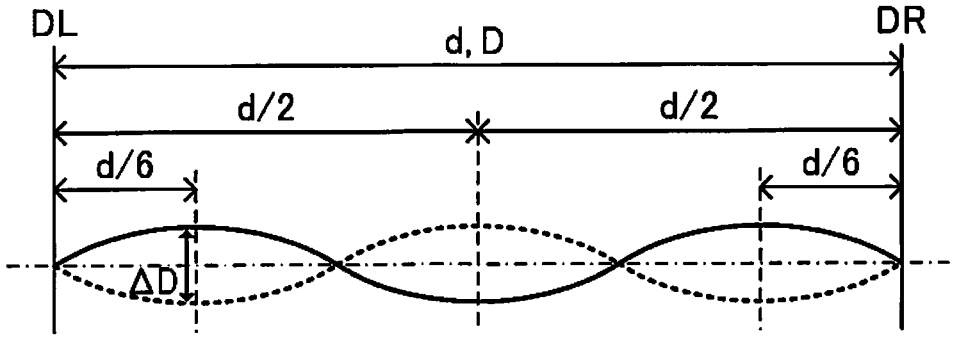
FIG. 20 is a diagram exemplifying a case where a third natural vibration occurs in the vibration plate.

FIG. 20 is a diagram exemplifying a case where a tertiary natural vibration occurs in the vibration plate 621. As illustrated in FIG. 20, in a case where the tertiary natural vibration occurs in the vibration plate 621, the displacement ΔD of the vibration plate 621 caused by the natural vibration is maximum at a point where the distance from the first contact point DL is d/2 and the distance from the second contact point DR is d/2, a point where the distance from the first contact point DL is d/6, and a point where the distance from the second contact point DR is d/6.

As described above, a greater stress F2 may be applied to the contact point α between the vibration plate 621 and the cavity 631 at the point where the displacement ΔD of the vibration plate 621 is maximum in the direction Y. In a case where the stress F2 greater than an assumed stress is concentrated at the contact point α between the vibration plate 621 and the cavity 631, a crack may occur in the vibration plate 621. Furthermore, in a case where the drive signal COM is applied to the first electrode 611 in a state in which a displacement larger than an assumed displacement occurs in the vibration plate 621, an excessive load may be applied to the vibration plate 621 along with the displacement of the piezoelectric element 60. As a result, the crack may occur in the vibration plate 621.

Since the voltage value of the reference voltage signal VBS is different between the standby mode and the sleep mode, the voltage value of the reference voltage signal VBS is controlled to decrease in the transition mode. Thus, if the voltage value of the drive signal COM supplied to the first electrode 611 is constant, a potential difference between the drive signal COM and the reference voltage signal VBS increases. As a result, a potential difference between the first electrode 611 and the second electrode 612 of the piezoelectric element 60 increases, and the piezoelectric element 60 is displaced due to the potential difference. If the mode is shifted to the sleep mode in a state where the piezoelectric element 60 is displaced, the piezoelectric element 60 is held for a long time in a state where the displacement is maintained. As a result, the crack or the like may occur in the vibration plate 621.

If the crack occurs in the vibration plate 621, the ink filled in the cavity 631 leaks due to the crack. Accordingly, fluctuation may occur in the ejection amount of the ink with respect to a change in the internal volume of the cavity 631. As a result, accuracy of the ink ejection is reduced.

Furthermore, in a case where the ink leaked from the crack adheres to both the first electrode 611 and the second electrode 612, a current flows through the ink between the first electrode 611 and the second electrode 612. Accordingly, the voltage value of the reference voltage signal VBS supplied to the second electrode 612 varies. In the liquid ejecting apparatus 1 according to the first embodiment, the reference voltage signal VBS is commonly supplied to the plurality of piezoelectric elements 60. Accordingly, the variation of the voltage value of the reference voltage signal VBS affects the displacement of each of the plurality of piezoelectric elements 60. As a result, the ejection accuracy of the entire liquid ejecting apparatus 1 may be affected.

In order to reduce the crack occurring in the vibration plate 621, the transfer gate 234 is controlled to be turned on in the transition mode and the voltage value of the drive signal COM is controlled to approximate the voltage value of the reference voltage signal VBS, in the first embodiment. Thereby, in the transition mode, the potential difference between the first electrode 611 and the second electrode 612 of the piezoelectric element 60 is reduced. Thus, in the sleep mode, a possibility that the piezoelectric element 60 is maintained in a state of being largely displaced is reduced. As a result, the stress occurring in the displacement of the piezoelectric element 60 is reduced, and the possibility that the crack or the like occurs in the vibration plate 621 is reduced.

Here, operations of the liquid ejecting apparatus 1 in the standby mode, the transition mode, and the sleep mode will be specifically described with reference to FIGS. 21 and 22.

Figure 21:
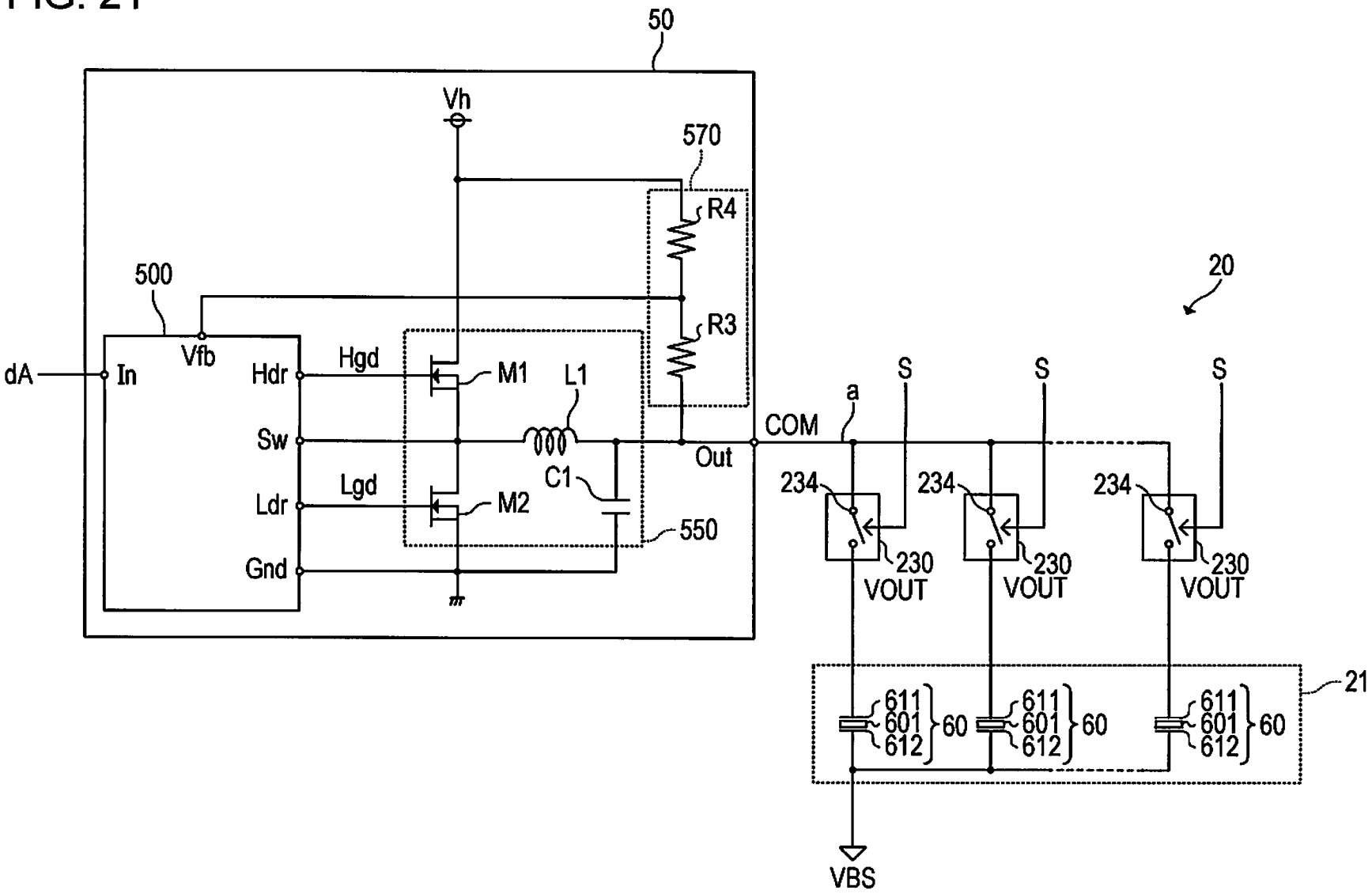
FIG. 21 is a configuration diagram illustrating a schematic configuration of a part of the liquid ejecting apparatus.

FIG. 21 is a configuration diagram illustrating a schematic configuration of a part of the liquid ejecting apparatus 1. FIG. 22 is a timing chart illustrating operations of the liquid ejecting apparatus 1 in the standby mode, the transition mode, and the sleep mode. FIG. 21 illustrates a simplified transfer gate 234 included in the selection circuit 230.

Figure 22:
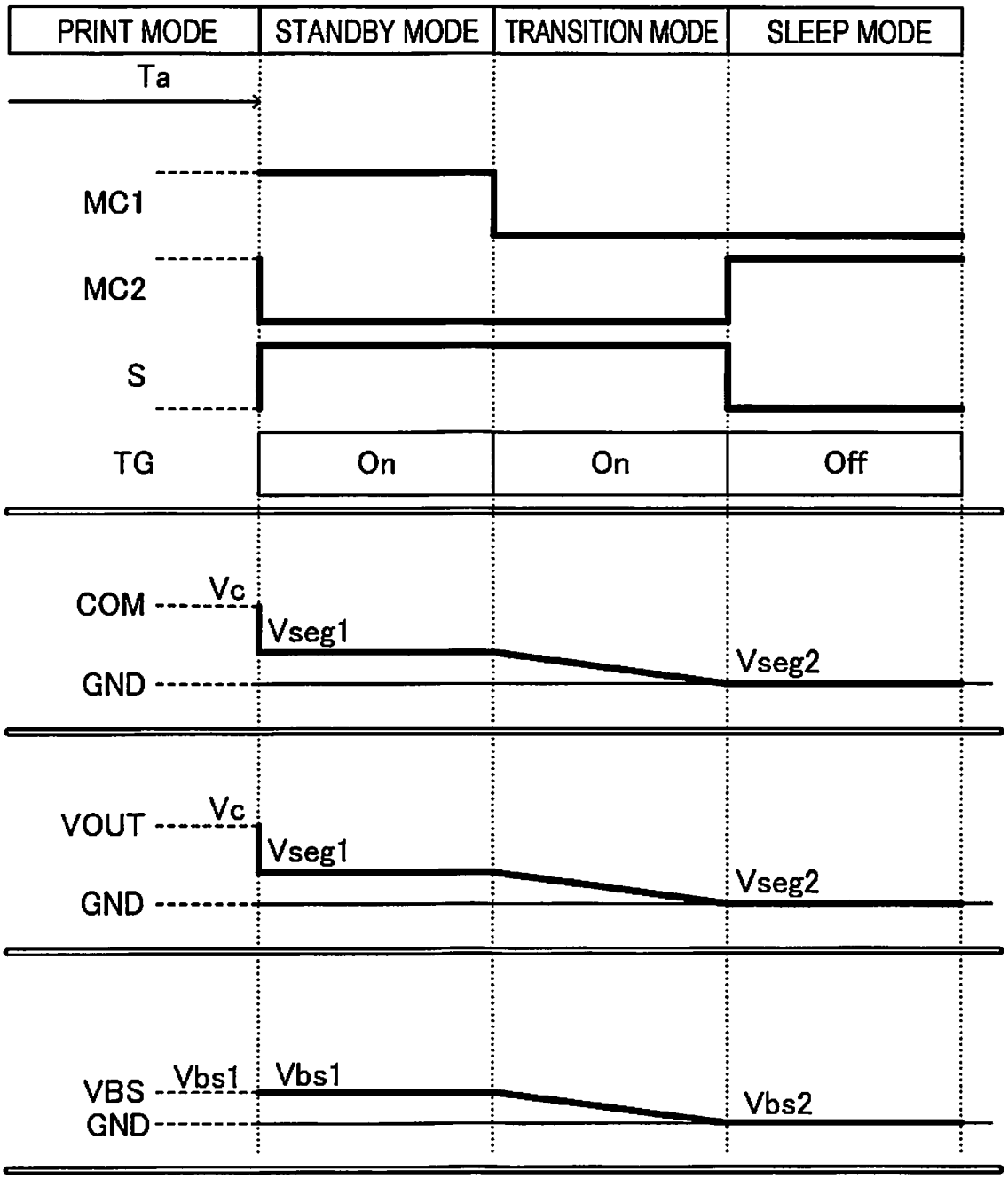
FIG. 22 is a timing chart illustrating operations in the standby mode, the transition mode, and the sleep mode.

As illustrated in FIG. 22, if the print mode ends, the liquid ejecting apparatus 1 is shifted to the standby mode. Specifically, the control circuit 100 makes the state signal MC2 go to an L level. Thereby, the selection signal S goes to an H level, and the transfer gate (TG) 234 is turned on.

As illustrated in FIGS. 21 and 22, in the standby mode, the control circuit 100 outputs data dA for causing the drive circuit 50 to generate the drive signal COM whose voltage value is the voltage Vseg1. The drive signal COM whose voltage value generated by the drive circuit 50 is the voltage Vseg1 is supplied to a node a to which the terminal Out and one end of the transfer gate 234 are connected. At this time, the voltage Vseg1 is controlled to approximate the voltage value of the reference voltage signal VBS.

Specifically, the data dA output from the control circuit 100 is a signal for controlling such that a duty ratio of the first amplification control signal Hgd output from the integrated circuit 500 is constant with respect to time. At this time, the duty ratio of the first amplification control signal Hgd may be controlled to be equal to a ratio of the voltage value of the reference voltage signal VBS to the voltage Vh supplied to the drain of the first transistor M1. In detail, for example, in a case where the voltage Vh is 42 V and the voltage value of the reference voltage signal VBS is 5 V, a duty ratio of an H level of the first amplification control signal Hgd is controlled to be approximately 12% (≅5/42×100).

The voltage Vseg1 may be controlled to approximate the voltage value of the reference voltage signal VBS and may not be the same voltage value. For example, a difference between the voltage Vseg1 and the voltage value of the reference voltage signal VBS may be controlled to be less than or equal to 2 V. Specifically, in a case where the voltage Vh is 42 V and the voltage value of the reference voltage signal VBS is 5 V, the voltage Vseg1 may be controlled between 3 V and 7 V. Thus, if the duty ratio of an H level of the first amplification control signal Hgd is controlled to be in the range from approximately 7% (×3/42×100) to approximately 17% (≅7/42×100).

Here, as described above, both the voltage values of the reference voltage signal VBS in the standby mode and the print mode are controlled to be the voltage Vbs1. As such, in the standby mode, by setting the voltage value of the reference voltage signal VBS supplied to the second electrode 612 of the piezoelectric element 60 to the same voltage Vbs1 as in the print mode, it is possible to reduce the time required for restarting print.

Figure 23:
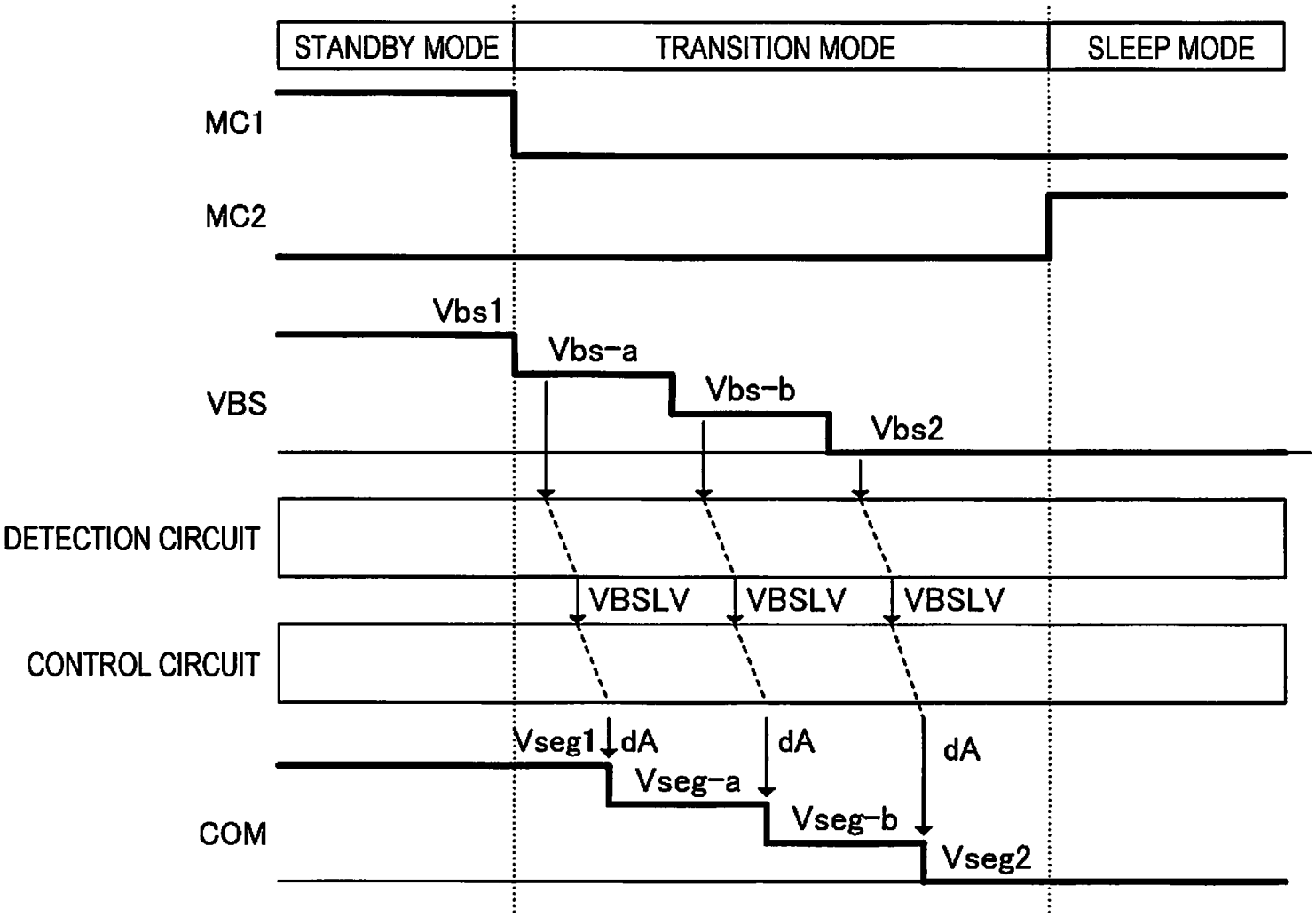
FIG. 23 is a diagram illustrating a relationship between a voltage value of the drive signal and a voltage value of the reference voltage signal in the transition mode.

Next, an operation in the transition mode will be described with reference to FIG. 23. FIG. 23 is a diagram illustrating a relationship between the voltage value of the drive signal COM and the voltage value of the reference voltage signal VBS in the transition mode.

The liquid ejecting apparatus 1 is shifted to the transition mode, and thereafter, if a predetermined time elapses, the liquid ejecting apparatus is shifted to the standby mode. Specifically, the control circuit 100 sets the state signal MC1 to an L level. Thereby, the selection signal S goes to the H level, and the transfer gate 234 is turned on. In the transition mode, the voltage generation circuit 70 changes the voltage value of the reference voltage signal VBS which is generated from the voltage Vbs1 to the voltage Vbs2. The voltage Vbs2 is a voltage value in the sleep mode and is smaller than the voltage Vbs1. That is, in the transition mode, the voltage value of the reference voltage signal VBS is controlled to decrease. The voltage value of the drive signal COM is controlled from the voltage Vseg1 to the voltage Vseg2 so as to follow the change in the voltage value of the reference voltage signal VBS. In other words, in the transition mode, the voltage value of the drive signal COM is controlled to approximate the voltage value of the reference voltage signal VBS.

Specifically, as illustrated in FIG. 23, if the standby mode is shifted to the transition mode, first, the voltage value of the reference voltage signal VBS is controlled from the voltage Vbs1 to the voltage Vbs-a lower than the voltage Vbs1. In the first embodiment, it is described that the voltage value of the reference voltage signal VBS is controlled by the voltage generation circuit 70, based on the state signals MC1 and MC2 output from the control circuit 100, but the voltage value of the reference voltage signal VBS may be configured to be controlled based on a signal (not illustrated) output by the control circuit 100.

The detection circuit 80 detects the voltage Vbs-a and outputs the reference voltage value signal VBSLV indicating the detection result to the control circuit 100. For example, the detection circuit 80 may include an A/D converter (not illustrated), convert the voltage Vbs-a to a digital signal, and output the digital signal to the control circuit 100 as the reference voltage value signal VBSLV.

The control circuit 100 generates the data dA, based on the input reference voltage value signal VBSLV and outputs the data to the drive circuit 50. The data dA at this time controls the voltage value of the drive signal COM so as to become the voltage Vseg-a equal to the voltage Vbs-a. For example, the data dA may be a signal that controls the duty ratio of the first amplification control signal Hgd so as to becomes a ratio of the voltage value of the voltage Vbs-a to the voltage value of the voltage Vh.

The drive circuit 50 generates the drive signal COM whose voltage value is the voltage Vseg-a, based on the input data dA, and outputs the drive signal to the node a.

Thereafter, the voltage value of the reference voltage signal VBS becomes a voltage Vbs-b lower than the voltage Vbs-a from the voltage Vbs-a.

The detection circuit 80 detects the voltage Vbs-b and outputs the reference voltage value signal VBSLV indicating the detection result to the control circuit 100.

The control circuit 100 generates the data dA, based on the input reference voltage value signal VBSLV and outputs the data to the drive circuit 50. The data dA at this time is controlled such that the voltage value of the drive signal COM becomes the voltage Vseg-b equal to the voltage Vbs-b. For example, the data dA may be a signal that controls the duty ratio of the first amplification control signal Hgd so as to be a value equal to a ratio of the voltage value of the voltage Vbs-b to the voltage value of the voltage Vh.

The drive circuit 50 generates the drive signal COM whose voltage value is the voltage Vseg-b based on the input data dA and outputs the drive signal to the node a.

Thereafter, the voltage value of the reference voltage signal VBS becomes a voltage Vbs2 lower than the voltage Vbs-b from the voltage Vbs-b.

The detection circuit 80 detects the voltage Vbs2 and outputs the reference voltage value signal VBSLV indicating the detection result to the control circuit 100.

The control circuit 100 generates the data dA, based on the input reference voltage value signal VBSLV and outputs the data to the drive circuit 50. The data dA at this time is a signal for controlling the voltage value of the drive signal COM so as to become the voltage Vseg2 equal to the voltage Vbs2. For example, the data dA may be a signal that controls the duty ratio of the first amplification control signal Hgd so as to become a value equal to a ratio of the voltage value of the voltage Vbs2 to the voltage value of the voltage Vh.

The drive circuit 50 generates the drive signal COM whose voltage value is the voltage Vseg2, based on the input data dA and outputs the data to the node a.

Thereafter, the voltage value of the reference voltage signal VBS maintains the voltage Vbs2.

The control circuit 100 outputs the data dA for controlling the voltage value of the drive signal COM so as to become the voltage Vseg2, and after a predetermined time elapses, the transition mode is shifted to the sleep mode.

In the present embodiment, it is described that the voltage value of the reference voltage signal VBS changes via the voltage values of two stages of the voltages Vbs-a and Vbs-b until the voltage value of the reference voltage signal VBS changes from the voltage Vbs1 to the voltage Vbs2, but the voltage value of the reference voltage signal VBS may change via the voltage values of three stages or more, or may change via only one voltage value.

If the liquid ejecting apparatus 1 is shifted to the sleep mode, the control circuit 100 sets the state signal MC2 to an H level. Thereby, the selection signal S goes to an L level, and the transfer gate 234 is turned off.

In the sleep mode, the control circuit 100 outputs the data dA for causing the drive circuit 50 to generate the drive signal COM whose voltage value is the voltage Vseg2. The drive signal COM whose voltage value is the voltage Vseg2 generated by the drive circuit 50 is supplied to the node a. At this time, the voltage Vseg2 is controlled to approximate the voltage Vbs2 of the reference voltage signal VBS.

For example, the data dA may be controlled such that the duty ratio of the first amplification control signal Hgd becomes a value equal to a ratio of the voltage value of the voltage Vbs2 to the voltage value of the voltage Vh.

Here, in the sleep mode, it is required to reduce power consumption. Thus, it is preferable that an operation of the voltage generation circuit 70 stop. That is, it is preferable that the voltage Vbs2 of the reference voltage signal VBS in the sleep mode be controlled to be a ground potential (0 V). Thus, it is preferable that the duty ratio of an H level of the first amplification control signal Hgd be controlled to be 0%, in other words, the second transistor M2 is controlled to keep an on state. Thereby, it is possible to further reduce the power consumption of the liquid ejecting apparatus 1 in the sleep mode.

As described above, in the liquid ejecting apparatus 1 of the first embodiment, the transfer gate 234 is controlled to be turned on in the transition mode, and the voltage value of the drive signal COM is controlled to approximate the voltage value of the reference voltage signal VBS. As such, by controlling the voltage value of the drive signal COM so as to approximate the voltage value of the reference voltage signal VBS in the transition mode, it is possible to reduce a potential difference between the first electrode 611 and the second electrode 612 of the piezoelectric element 60 in the transition mode. Thereby, it is possible to reduce the amount of displacements of the piezoelectric element 60 and the vibration plate 621.

Furthermore, since it is possible to reduce the potential difference between the first electrode 611 and the second electrode 612 of the piezoelectric element 60 in the transition mode, it is possible to reduce a potential difference between the voltage value held in the first electrode 611 and the voltage value held in the second electrode 612, in the sleep mode shifted from the transition mode. Thereby, it is possible to reduce the amount of displacements of the piezoelectric element 60 and the vibration plate 621.

Furthermore, according to the liquid ejecting apparatus 1 according to the first embodiment, even in a case where a plurality of nozzles 651 are provided at a density of 300 or more per inch and a plurality of piezoelectric elements 60 are provided corresponding to the plurality of nozzles 651, it is possible to obtain a large effect.

In a case where the nozzles 651 are provided at a density of 300 or more per inch, the piezoelectric elements 60 corresponding to the nozzle 651 are also provided with high density. Accordingly, a length of the piezoelectric element 60 in the direction X in which the piezoelectric elements 60 are juxtaposed is reduced, and as a result, areas of the first electrode 611 and the second electrode 612 are reduced.

As described above, the piezoelectric element 60 is displaced by the potential difference between the first electrode 611 and the second electrode 612. That is, a current based on the potential difference flows between the first electrode 611 and the second electrode 612. In a case where the piezoelectric elements 60 are provided at a high density, the areas of the first electrode 611 and the second electrode 612 are reduced, and thereby, a current density between the first electrode 611 and the second electrode 612 increases. Thus, a resistance component between the first electrode 611 and the second electrode 612 of the piezoelectric element 60 increases.

In the recording head 21 including the nozzles 651 and the piezoelectric elements 60 provided with a high density, in a case where a large potential difference is generated between the first electrode 611 and the second electrode 612 in the sleep mode in which the transfer gate 234 is turned off, the resistance component between the first electrode 611 and the second electrode 612 increases, and thereby, the electric charge of the first electrode 611 is hard to be released, and Accordingly, a voltage of the first electrode 611 is hard to be discharged.

In the liquid ejecting apparatus 1 according to the first embodiment, the voltage value of the first electrode 611 is controlled to approximate the voltage value of the second electrode 612 in the transition mode immediately before the mode is shifted to the sleep mode, and thereby, the potential difference between the first electrode 611 and the second electrode 612 in the sleep mode can be reduced. Thus, even in a case where the resistance component between the first electrode 611 and the second electrode 612 increases because the piezoelectric elements 60 are provided at a high density, the displacement of the piezoelectric element 60 can be reduced. Thus, it is possible to reduce a possibility that a stress is continuously applied to the piezoelectric element 60 and the vibration plate 621 and a crack or the like occurs in the vibration plate 621 due to the stress.

As illustrated in FIGS. 5 and 21, the drive circuit 50 includes the first feedback circuit 570 which feeds back the drive signal COM that is pulled up to the high voltage Vh and is output from the terminal Out. That is, the voltage Vh having a voltage value higher than the voltage value of the drive signal COM and the voltage value of the reference voltage signal VBS is input to the node a via the resistor R3 and the resistor R4 which are resistance elements included in the first feedback circuit 570. Accordingly, in a case where the drive signal COM output to the node a by the drive circuit 50 is not controlled, a signal whose voltage value based on the high voltage Vh is undefined is supplied to the node a.

If the transfer gate 234 is controlled to be turned on in a state where a signal having the undefined voltage value is supplied to the node a, the voltage signal having the undefined voltage value is supplied to the first electrode 611, and thereby, an unintended displacement may occur in the piezoelectric element 60. Alternatively, if the transfer gate 234 is controlled to be turned off, an unintended voltage is supplied to the first electrode 611 due to a leakage current based on the signal whose voltage value is undefined, and thereby, an unintended displacement may occur in the piezoelectric element 60.

In the first embodiment, in the print mode, the drive signal COM configured by a voltage waveform in which voltage waveforms Adp, Bdp, and Cdp are consecutive is supplied to the node a. In addition, in the standby mode, the drive signal COM controlled to approximate the voltage Vbs1 which is the voltage value of the reference voltage signal VBS is supplied to the node a. In addition, in the transition mode, the drive signal COM controlled to approximate the voltage value of the reference voltage signal VBS which changes from the voltage Vbs1 to the voltage Vbs2 is supplied to the node a. In addition, in the sleep mode, the drive signal COM controlled to approximate the voltage Vbs2 which is the voltage value of the reference voltage signal VBS is supplied to the node a.

As described above, the voltage signal supplied to the node a in the liquid ejecting apparatus 1 according to the first embodiment is controlled by the drive signal COM in any of the print mode, the standby mode, the transition mode, and the sleep mode. Thus, an unintended voltage is not supplied to the first electrode 611 of the piezoelectric element 60, and a possibility that an unintended displacement occurs in the piezoelectric element 60 is reduced.

2. Second Embodiment

Next, a liquid ejecting apparatus 1 according to a second embodiment will be described. In describing the liquid ejecting apparatus 1 according to the second embodiment, the same reference numerals or symbols are given to the same configurations as in the liquid ejecting apparatus 1 according to the first embodiment, and description thereof will be omitted or simplified. The liquid ejecting apparatus 1 according to the second embodiment is different from the liquid ejecting apparatus 1 according to the first embodiment in that the transfer gate 234 included in the selection circuit 230 is controlled to be turned on in the sleep mode.

FIG. 24 is a diagram illustrating content of decoding performed by the decoder 216 in the liquid ejecting apparatus 1 according to the second embodiment. In a case where both the state signals MC1 and MC2 are in the print mode of an H level, the decoder 216 according to the second embodiment outputs the selection signal S of a logic level based on the print data [SIH, SIL] in each of the periods T1, T2, and T3 defined by the latch signal LAT and the change signal CH, in the same manner as in the first embodiment. Thereby, the liquid ejecting apparatus 1 forms a large dot, a medium dot, a small dot, or a minute vibration on the medium P. That is, in the print mode according to the second embodiment, ink is ejected from the nozzle 651, and the voltage value of the reference voltage signal VBS is controlled to be the voltage Vbs1, in the same manner as in the first embodiment.

As illustrated in FIG. 24, the decoder 216 determines a logic level of the selection signal S in response to the state signals MC1 and MC2 in the standby mode, the transition mode, and the sleep mode.

Specifically, in a case where the state signals MC1 and MC2 are in the standby mode of H and L levels, respectively, the selection circuit 230 selects the drive signal COM whose voltage value is the voltage Vseg1, according to the input selection signal S of an H level. As a result, the drive signal VOUT whose voltage value is the voltage Vseg1 is supplied to the ejection unit 600. That is, in the standby mode of the second embodiment, in the same manner as in the first embodiment, ink is not ejected from the nozzle 651, the voltage value of the reference voltage signal VBS is controlled to be the voltage Vbs1, the voltage value of the drive signal COM Is controlled to be the voltage Vseg1 so as to approximate the voltage Vbs1, and the transfer gate 234 is controlled to be turned on.

In a case where both the state signals MC1 and MC2 are in the shift mode of an L level, the selection circuit 230 selects the drive signal COM whose voltage value changes from the voltage Vseg1 to the voltage Vseg2, according to the input selection signal S of an H level. As a result, the drive signal VOUT whose voltage value changes from the voltage Vseg1 to the voltage Vseg2 is supplied to the ejection unit 600. That is, in the transition mode of the second embodiment, in the same manner as in the first embodiment, ink is not ejected from the nozzle 651, the voltage value of the reference voltage signal VBS is controlled to be the voltage Vbs2 lower than the voltage Vbs1 from the voltage Vbs1, the voltage value of the drive signal COM is controlled to be the voltage Vseg2 from the voltage Vseg1 so as to approximate the voltage value of the reference voltage signal VBS, and the transfer gate 234 is controlled to be turned on.

In a case where the state signals MC1 and MC2 are in the sleep mode of L and H levels, respectively, the selection circuit 230 selects the drive signal COM whose voltage value is the voltage Vseg2, according to the input selection signal S of an H level. As a result, the drive signal VOUT whose voltage value is the voltage Vseg2 is supplied to the ejection unit 600. That is, in the sleep mode of the second embodiment, the ink is not ejected from the nozzle 651, the voltage value of the reference voltage signal VBS is controlled to be the voltage Vbs2 lower than the voltage Vbs1, the voltage value of the drive signal COM is controlled to be the voltage Vseg2 so as to approximate the voltage value of the reference voltage signal VBS, and the transfer gate 234 is controlled to be turned on.

The liquid ejecting apparatus 1 according to the second embodiment which is configured as described above can achieve the same effects as in the first embodiment. Here, the print mode is an example of a first mode in the second embodiment, and the sleep mode is an example of a third mode in the second embodiment.

In the transition mode of the liquid ejecting apparatus 1 according to the second embodiment, the decoder 216 may output the selection signal S of an L level. The transition mode is an operation mode with a short stay time for the standby mode and the sleep mode. Accordingly, in the sleep mode, the voltage value of the reference voltage signal VBS is controlled to be the voltage Vbs2 lower than the voltage Vbs1, the voltage value of the drive signal COM is controlled to be the voltage Vseg2 so as to approximate the voltage value of the reference voltage signal VBS, and in a case where the transfer gate 234 is controlled to be turned on, even if the transfer gate 234 is controlled to be turned on in the transition mode, the voltage value supplied to the first electrode 611 of the piezoelectric element 60 can be controlled in the sleep mode. Thus, it is possible to reduce a continuous application of an unintended stress to the piezoelectric element 60 and the vibration plate 621. That is, the liquid ejecting apparatus 1 according to the second embodiment, can obtain the same effect as in the first embodiment, even if the transfer gate 234 is controlled to be turned off in the transition mode.

3. Third Embodiment

Next, a liquid ejecting apparatus 1 according to a third embodiment will be described. In describing the liquid ejecting apparatus 1 according to the third embodiment, the same reference numerals or symbols are given to the same configurations as in the liquid ejecting apparatus 1 according to the first embodiment and the second embodiment, and description thereof will be omitted or simplified. The liquid ejecting apparatus 1 according to the third embodiment is different from the first embodiment and the second embodiment in that a discharge circuit 300 for discharging electric charge stored in the node a between the terminal Out and the first electrode 611 is included.

Figure 25:
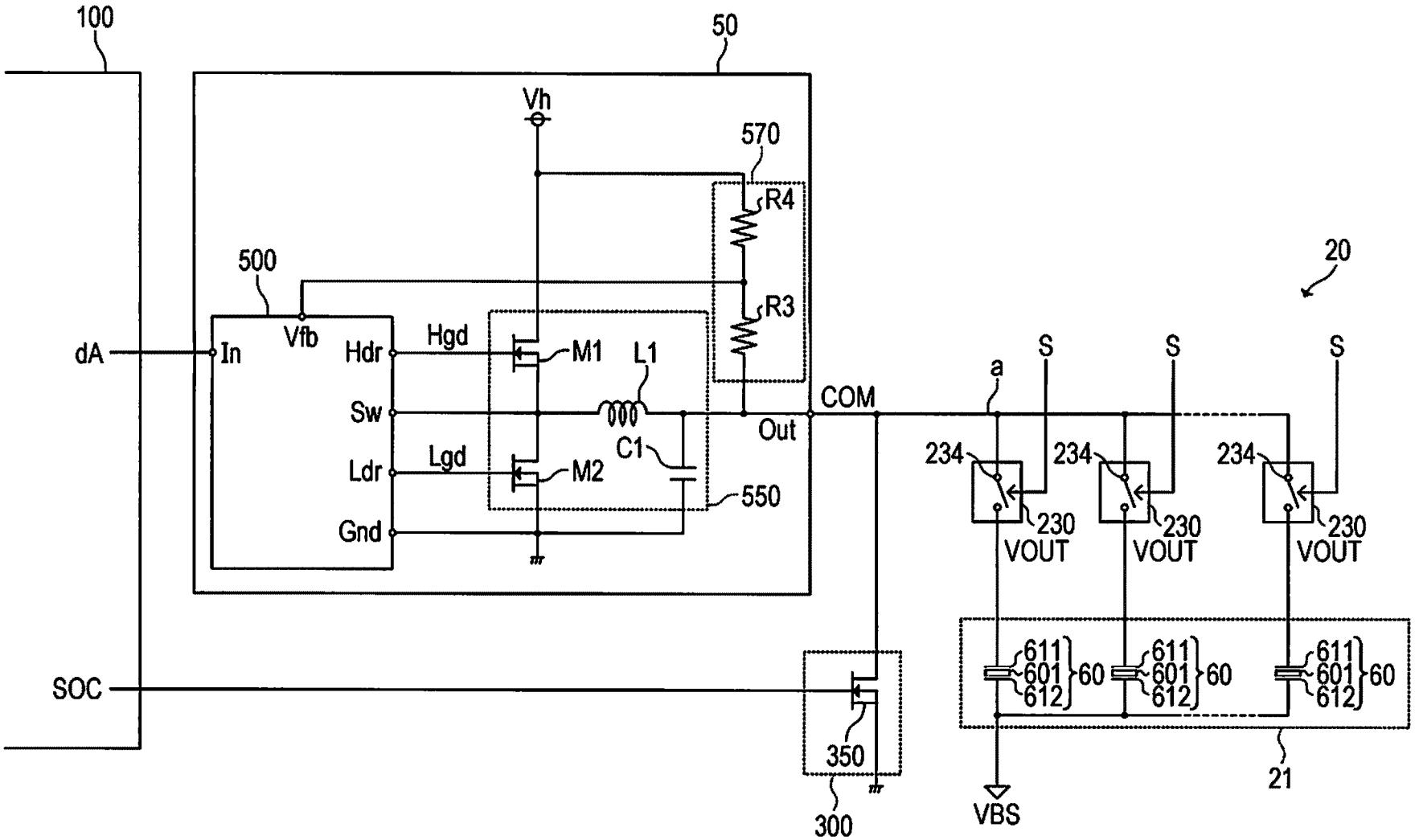
FIG. 25 is a configuration diagram illustrating a schematic configuration of a part of a liquid ejecting apparatus according to a third embodiment.

FIG. 25 is a configuration diagram illustrating a schematic configuration of a part of the liquid ejecting apparatus 1 according to the third embodiment. As illustrated in FIG. 25, the liquid ejecting apparatus 1 according to the third embodiment includes the discharge circuit 300 that discharges electric charges between the terminal Out from which the drive signal COM is output, and the ground potential.

Specifically, the discharge circuit 300 includes a transistor 350. The transistor 350 is, for example, an NMOS transistor. A drain terminal, which is one end of the transistor 350, is electrically connected to the terminal Out. A source terminal which is the other end of the transistor 350 is connected to the ground potential. A control signal SOC output from the control circuit 100 is input to a gate terminal of the transistor 350.

In a case where an operation mode of the liquid ejecting apparatus 1 is shifted to the sleep mode, the control circuit 100 outputs the control signal SOC at an H level and supplies the data dA for stopping the operation of the drive circuit 50 to the drive circuit 50. Thereby, the transistor 350 is controlled to be turned on and an operation of the drive circuit 50 stops.

Thereby, electric charges stored in the node a in the sleep mode can be discharged via the discharge circuit 300, and the operation of the drive circuit 50 in the sleep mode can be stopped. Thus, it is possible to achieve the same effects as in the first embodiment and the second embodiment, and it is possible to further reduce power consumption of the liquid ejecting apparatus 1 in the sleep mode.

The transistor 350 is not limited to the NMOS transistor, and may be, for example, a PMOS transistor. In this case, a source terminal which is one end of the PMOS transistor is electrically connected to the terminal Out, and a drain terminal which is the other end of the PMOS transistor is connected to the ground potential. In a case where the liquid ejecting apparatus 1 is shifted to the sleep mode, a control signal SOC of an L level is supplied from the control circuit 100 to a gate terminal of the PMOS transistor. Here, the transistor 350 is an example of the second switch element.

4. Modification Example

In the above embodiment, the detection circuit 80 detects the reference voltage signal VBS in the transition mode, generates the reference voltage value signal VBSLV, and outputs the reference voltage value signal to the control circuit 100. However, the detection circuit 80 may detect the drive signal COM and the reference voltage signal VBS in the transition mode and may output the reference voltage value signal VBSLV indicating a difference to the control circuit 100. Thereby, it is possible to make the voltage value of the drive signal COM in the transition mode closer to the voltage value of the reference voltage signal VBS.

In the above embodiment, in a case where the mode is shifted to the transition mode, the reference voltage signal VBS is controlled so as to gradually decrease from the voltage Vbs1 to the voltage Vbs2, but in a case where the mode is shifted to the transition mode, the reference voltage signal VBS may be controlled so as to directly become the voltage Vbs2 from the voltage Vbs1, and in a case where the mode is shifted to the transition mode, the drive signal COM may be controlled so as to gradually change from the voltage Vseg1 to the voltage Vseg2 in a predetermined time.

Figure 26:
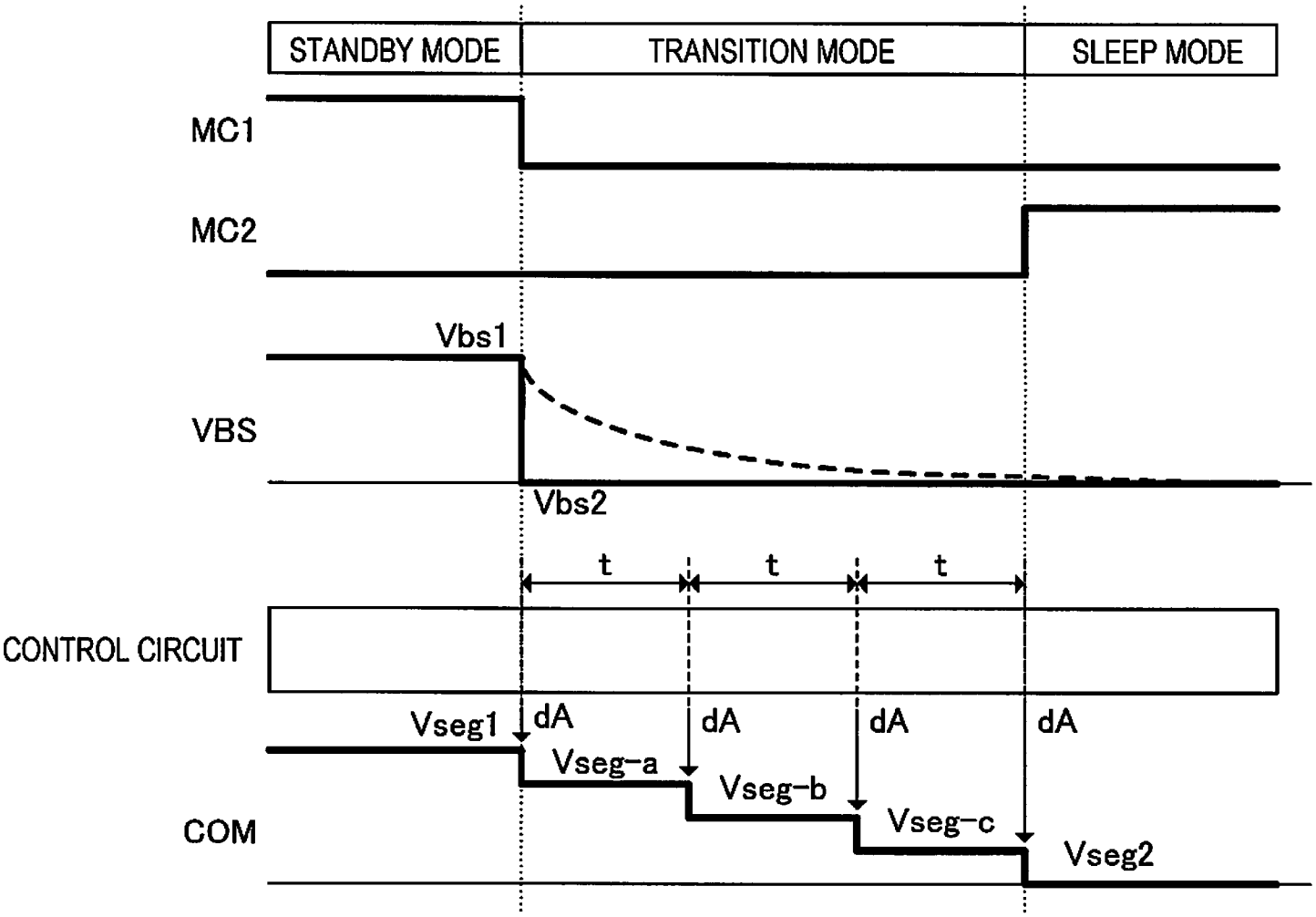
FIG. 26 is a diagram illustrating a modification example of a relationship between the voltage value of the drive signal and the voltage value of the reference voltage signal in the transition mode.

Specifically, as illustrated in FIG. 26, in a case where the mode is shifted to the transition mode, the reference voltage signal VBS may be controlled so as to be the voltage Vbs2 from the voltage Vbs1. In this case, the voltage value of the reference voltage signal VBS gradually decreases as indicated by a dashed line in FIG. 26 due to, for example, a capacitance component included in the liquid ejecting apparatus 1.

Meanwhile, in a case where the mode is shifted to the transition mode, the drive signal COM is output as a voltage signal which decreases by a predetermined voltage value in each predetermined period t. Specifically, as illustrated in FIG. 26, immediately after the mode is shifted to the transition mode, the voltage value of the drive signal COM is controlled so as to become the voltage Vseg-a from the voltage Vseg1. Then, in a case where the predetermined period t elapses after the mode is shifted to the transition mode, the voltage value of the drive signal COM is controlled so as to become the voltage Vseg-b from the voltage Vseg-a. In the same manner, in a case where the predetermined period t elapses after the voltage value of the drive signal COM is controlled to become the voltage Vseg-b, the voltage value of the drive signal COM is controlled to become the voltage Vseg-c from the voltage Vseg-b. Then, in a case where the predetermined period t elapses after the voltage value of the drive signal COM is controlled to become the voltage Vseg-c, the voltage value of the drive signal COM is controlled so as to become the voltage Vseg2 from the voltage Vseg-c. In this case, by controlling the amount of change in the voltage value of the drive signal COM for each predetermined period t and controlling time from the voltage Vseg1 to the voltage Vseg2, the voltage value of the drive signal COM may be controlled to approximate the voltage value of the reference voltage signal VBS.

In the above-described embodiment, the liquid ejecting apparatus 1 is configured as a serial type ink jet printer in which the head unit 20 including the ejection unit 600 is provided in the carriage 24 and printing is performed on the medium P by moving the carriage 24, but the liquid ejecting apparatus 1 may be a line head type ink jet printer in which a plurality of the recording heads 21 are provided in the direction X which is a main scan direction orthogonal to a transport direction of the medium P, and printing is performed by merely transporting the medium P.

Although the embodiments and the modification example are described above, the invention is not limited to the embodiments, and can be implemented in various types without departing from a gist thereof. For example, the above-described embodiments can be combined as appropriate.

The invention includes substantially the same configuration as the configuration (for example, a configuration having the same function, method, and result, or a configuration having the same object and effect) described in the embodiment. In addition, the invention includes a configuration in which a non-essential part of the configuration described in the embodiment is replaced. In addition, the invention includes a configuration that achieves the same operation and effect as the configuration described in the embodiment, or a configuration that can achieve the same object. In addition, the invention includes a configuration in which a well-known technique is added to the configuration described in the embodiment.

What is claimed is:

1. A liquid ejecting apparatus comprising:

a drive circuit in which a first voltage signal is output from an output terminal;

a piezoelectric element that includes a first electrode to which the first voltage signal is supplied and a second electrode to which a second voltage signal is supplied and is displaced by a potential difference between the first electrode and the second electrode;

a cavity which is filled with a liquid that is ejected from a nozzle in accordance with the displacement of the piezoelectric element;

a vibration plate that is provided between the cavity and the piezoelectric element; and a first switch element that is electrically connected to the output terminal and the first electrode, wherein the liquid ejecting apparatus has a first mode in which the liquid is ejected and a voltage value of the second voltage signal is controlled to be a first voltage; and a second mode in which the liquid is not ejected, the voltage value of the second voltage signal is controlled to be a second voltage lower than the first voltage, a voltage value of the first voltage signal is controlled to approximate the voltage value of the second voltage signal, and the first switch element is controlled to be turned on.

2. The liquid ejecting apparatus according to claim 1, wherein printing is not performed on a medium in the second mode.

3. A liquid ejecting apparatus comprising:

a drive circuit in which a first voltage signal is output from an output terminal;

a piezoelectric element that includes a first electrode to which the first voltage signal is supplied and a second electrode to which a second voltage signal is supplied and is displaced by a potential difference between the first electrode and the second electrode;

a cavity which is filled with a liquid that is ejected from a nozzle in accordance with the displacement of the piezoelectric element;

a vibration plate that is provided between the cavity and the piezoelectric element; and a first switch element that is electrically connected to the output terminal and the first electrode, wherein the liquid ejecting apparatus has a first mode in which the liquid is ejected and a voltage value of the second voltage signal is controlled to be a first voltage; and a third mode in which the liquid is not ejected, the voltage value of the second voltage signal is a second voltage lower than the first voltage, a voltage value of the first voltage signal is controlled so as to become the voltage value of the second voltage signal, and the first switch element is controlled to be turned on.

4. The liquid ejecting apparatus according to claim 3, wherein printing is not performed on a medium in the third mode.

5. The liquid ejecting apparatus according to claim 1, wherein a plurality of the nozzles are provided at a density of 300 or more per inch, and wherein a plurality of the piezoelectric elements are provided corresponding to the plurality of nozzles.

6. The liquid ejecting apparatus according to claim 1, wherein a third voltage signal having a voltage value higher than the voltage value of the first voltage signal and the voltage value of the second voltage signal is input to a node which is electrically connected to the output terminal and the first switch element, via a resistance element.

7. The liquid ejecting apparatus according to claim 1, wherein the drive circuit includes a feedback circuit that feeds back the first voltage signal which is output from the output terminal, a modulation circuit that generates a modulation signal, based on an original signal which is a source of the first voltage signal and a signal which is obtained by feeding back the first voltage signal, and an output circuit that generates the first voltage signal by amplifying and demodulating the modulation signal.

8. The liquid ejecting apparatus according to claim 1, further comprising:

a discharge circuit that discharges electric charges between the output terminal and the first electrode.

9. The liquid ejecting apparatus according to claim 8, wherein the discharge circuit includes a second switch element having one end which is electrically connected to the output terminal and the other end which is connected to a ground potential.

10. The liquid ejecting apparatus according to claim 1, further comprising a voltage generation circuit configured to variably control the voltage value of the second voltage signal.

11. The liquid ejecting apparatus according to claim 3, further comprising a voltage generation circuit configured to variably control the voltage value of the second voltage signal.

* * * * *